US011400735B2

(12) United States Patent
Yoshikawa

(10) Patent No.: US 11,400,735 B2
(45) Date of Patent: Aug. 2, 2022

(54) PRINTING UNIT AND THERMAL PRINTER

(71) Applicant: Seiko Instruments Inc., Chiba (JP)

(72) Inventor: Fumitaka Yoshikawa, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 17/106,815

(22) Filed: Nov. 30, 2020

(65) Prior Publication Data

US 2021/0162781 A1 Jun. 3, 2021

(30) Foreign Application Priority Data

Dec. 2, 2019 (JP) ..... JP2019-217702
Mar. 26, 2020 (JP) ..... JP2020-056786
Jul. 27, 2020 (JP) ..... JP2020-126199

(51) Int. Cl.
*B41J 11/057* (2006.01)
*B41J 2/32* (2006.01)
*B41J 11/66* (2006.01)
*B41J 15/04* (2006.01)

(52) U.S. Cl.
CPC ..... *B41J 11/057* (2013.01); *B41J 2/32* (2013.01); *B41J 11/66* (2013.01); *B41J 15/04* (2013.01); *B41J 2202/31* (2013.01)

(58) Field of Classification Search
CPC ... B41J 11/70; B41J 11/20; B41J 11/14; B41J 11/18; B41J 2/32; B41J 15/04; B41J 2202/31; B41J 25/34; B41J 11/02; B41J 11/04; B41J 11/06; B41J 11/08; B41J 11/10; B41J 11/13; B41J 11/053; B41J 11/057; B41J 11/66; B41J 11/703
See application file for complete search history.

(56) References Cited

U.S. PATENT DOCUMENTS

| | | | |
|---|---|---|---|
| 6,249,302 | B1 | 6/2001 | Sekiya |
| 2007/0059074 | A1 | 3/2007 | Yoshioka |
| 2009/0317163 | A1 | 12/2009 | Kohira et al. |
| 2016/0059588 | A1 | 3/2016 | Aizawa |
| 2017/0144455 | A1 | 5/2017 | Ishikawa et al. |
| 2019/0030923 | A1 | 1/2019 | Sudo |

FOREIGN PATENT DOCUMENTS

| | | |
|---|---|---|
| EP | 3546230 A1 | 10/2019 |
| JP | 2000-31826 | 11/2000 |

OTHER PUBLICATIONS

Extended European Search Report in Europe Application No. 20211285.0, dated Apr. 15, 2021, 8 pages.

*Primary Examiner* — Kristal Feggins
(74) *Attorney, Agent, or Firm* — Crowell & Moring LLP

(57) ABSTRACT

A printing unit includes a platen lock mechanism for switching between a locked state and an unlock state of the platen roller; and an urging member for urging the lock arm. The head unit has receiving grooves receiving the platen bearings through an opening. A lock arm presses the platen bearings when the operation lever is at the lock position, and is configured to allow disengagement of the platen bearings from the receiving groove through the opening by being swung from the lock position toward the unlock position side. The lock arm includes a pushing-up arm configured to push the platen bearings from the receiving groove toward the opening side along with movement of the operation lever from the lock position toward the unlock position. An urging member urges the lock arm toward the platen unit side.

12 Claims, 33 Drawing Sheets

PRINTING UNIT AND THERMAL PRINTER

RELATED APPLICATIONS

This application claims priority to Japanese Patent Application No. 2019-217702, filed Dec. 2, 2019, Japanese Patent Application No, 2020-056786, filed Mar. 26, 2020, and Japanese Patent Application No. 2020-126199 filed Jul. 27, 2020, the entire contents of which are incorporated herein by reference.

BACKGROUND OF THE INVENTION

1. Field of the Invention

The present invention relates to a printing unit and a thermal printer.

2. Description of the Related Art

As a thermal printer, there has been known a printer in which a thermal head and a platen roller are detachably combined with each other.

For example, there has been known a thermal printer in which a head unit including a thermal head is provided on a side of a casing configured to receive a roll sheet, and in which a platen unit including a platen roller is provided on a side of a printer cover that is coupled to the casing so as to be operated in an openable and closable manner. According to this thermal printer, the thermal head and the platen roller can be detachably combined with each other along with an opening and closing operation of the printer cover.

In general, in many cases, the thermal printer of this type includes a lock mechanism configured to hold the platen roller in order to prevent detachment between the thermal head and the platen roller at an unintended timing when the thermal head and the platen roller are combined with each other. As the lock mechanism, for example, there has been known a lock mechanism configured to press bearings, which are respectively provided at both end portions of a platen shaft, through use of a spring member. The spring member is provided on the head unit on the casing side, and presses the bearings through use of its own elastic restoration force (spring force) when the bearings are fitted in bearing grooves. With this, the bearings can be pressed against the bearing grooves with a constant pressing force, thereby being capable of locking (holding) the platen roller.

However, in the case of the type of locking the platen roller through use of the spring member, the bearings are merely pressed with the spring member, and hence the platen roller is liable to be insufficiently locked. Accordingly, there is a fear in that, for example, when an external force acts on the platen roller, the bearings are moved in a direction of slipping out of the bearing grooves. Thus, the meshing between a driven gear, which is provided integrally with the bearing, and a gear train, which is configured to drive the platen roller, becomes insufficient, and there is a risk of causing a problem called "tooth skipping" or a problem that the meshing itself is released. Moreover, there is also a risk that the bearings slip out of the bearing grooves to cause the head unit and the platen unit to be detached from each other. In particular, when the platen unit is provided on the printer cover, the external force is liable to act on the platen roller through a platen cover, and hence the above-mentioned problems are liable to arise.

As countermeasures against the above-mentioned problems, for example, it is conceivable to increase the spring force of the spring member. However, in this case, when the head unit and the platen unit are detached from each other, it is difficult to pull the bearings out of the bearing grooves, and hence a large force is required for releasing the platen roller. Accordingly, degradation in operability is brought about.

Therefore, there has been known a thermal printer adopting a lock arm type in which the platen roller is locked through use of a lock arm in place of the spring member. For example, there has been known a thermal printer in which bearings are pressed against bearing grooves with the lock arm through use of a spring force of a head pressure spring configured to bring the thermal head into press-contact with the platen roller, thereby locking the platen roller. According to this thermal printer, the lock arm is used in place of the spring member. Therefore, the bearings can be prevented from moving so as to slip out of the bearing grooves.

However, even in the case of the lock arm type, the lock arm is pressed against the bearing through use of the spring force of the head pressure spring. Thus, a force required for releasing the platen roller is dependent on the spring force of the head pressure spring, and is liable to be increased more than necessary. Accordingly, the degradation in operability is easily brought about similarly, and there is room for improvement.

Moreover, in general, the lock arm of this type is configured to lock the bearing from the platen unit side, and hence at the time of unlocking, the lock arm moves toward the platen unit side so as to separate away from the thermal head side. Therefore, it is required to secure a motion space in consideration of a movable stroke amount of the lock arm, and hence it is required to design the platen unit having a large size. The platen unit typically has fewer components than the head unit, and hence it is desired to design the platen unit having a compact size in order to achieve downsizing and thinning of the platen unit. However, as described above, it is required to secure the motion space for the lock arm, and hence it is difficult to design the platen unit having a compact size. Accordingly, when the motion space is secured, a size of the entire printer is consequently influenced, and thus limitations are imposed on the design.

Therefore, in the technical field of the present invention, there have been demands for a printing unit and a thermal printer capable of reliably locking a platen roller, smoothly unlocking the platen roller by a slight operating force, and achieving reduction in contour size.

SUMMARY OF THE INVENTION

According to one embodiment of the present invention, there is provided a printing unit, including a head unit including: a thermal head configured to perform printing on a recording sheet; a platen unit which is detachably combined with the head unit, and includes a platen roller configured to feed the recording sheet; and a pair of platen bearings configured to support both end portions of the platen roller in a rotatable manner; an operation lever which is movable about a rotation axis between a lock position of locking the platen unit to the head unit and an unlock position of unlocking the platen unit from the head unit; a platen lock mechanism which includes a lock arm swingable about a swing axis parallel to the platen roller, and is configured to switch the lock arm between a lock state of locking the platen roller and an unlock state of unlocking the platen roller; and an urging member configured to urge the lock arm about the swing axis so as to maintain the lock state, wherein the head unit has a pair of receiving grooves which is configured to allow the pair of platen bearings to be fitted therein through openings of the pair of receiving grooves, and configured to receive the pair of platen bearings in contact with groove bottom portions of the pair of receiving grooves when the operation lever is at the lock position, wherein the lock arm is configured to press at least one of the pair of platen bearings received in the receiving groove from the opening side when the operation lever is at the lock position, and is configured to allow disengagement of the at least one of the pair of platen bearings from the receiving groove through the opening by being swung about the swing axis along with movement of the operation lever from the lock position toward the unlock position side, wherein the lock arm includes a pushing-up arm configured to push the at least one of the pair of platen bearings from the groove bottom portion toward the opening side along with movement of the operation lever from the lock position toward the unlock position, and wherein the urging member urges the lock arm toward the platen unit side.

In the above-mentioned printing unit according to the one embodiment of the present invention, wherein the lock arm allows disengagement of the at least one of the pair of platen bearings from the receiving groove through the opening by being swung about the swing axis from the platen unit side toward the head unit side along with movement of the operation lever from the lock position toward the unlock position side.

In the above-mentioned printing unit according to the one embodiment of the present invention, wherein the pushing-up arm is held in non-contact with the at least one of the pair of platen bearings when the operation lever is at the lock position.

In the above-mentioned printing unit according to the one embodiment of the present invention, wherein on an inner surface of the receiving groove, an inclined guide protrusion configured to guide the at least one of the pair of platen bearings toward the groove bottom portion is formed so as to decrease an opening width from the opening side toward the groove bottom portion side, and wherein the pushing-up arm pushes the at least one of the pair of platen bearings so as to move a roller center of the platen roller more toward the opening side than an apex portion of the guide protrusion.

In the above-mentioned printing unit according to the one embodiment of the present invention, wherein the lock arm includes a pair of lock arms arranged on both sides of the platen roller across the platen roller so as to correspond to the pair of platen bearings, respectively, and wherein the platen lock mechanism includes a coupling shaft portion that extends along the swing axis and is configured to couple the pair of lock arms to each other.

The above-mentioned printing unit according to the one embodiment of the present invention, further includes: a fixed blade provided on one of the head unit and the platen unit; a movable blade provided on another one of the head unit and the platen unit so as to be movable relative to the fixed blade; and a drive mechanism which includes a drive rack coupled to the movable blade, and is configured to move the movable blade between a standby position at which the movable blade is away from the fixed blade and a cutting position at which the movable blade climbs over the fixed blade; a fixed blade provided on one of the head unit and the platen unit; a movable blade provided on another one of the head unit and the platen unit so as to be movable relative to the fixed blade; and a drive mechanism which includes a drive rack coupled to the movable blade, and is configured to move the movable blade between a standby position at which the movable blade is away from the fixed blade and a cutting position at which the movable blade climbs over the fixed blade.

The above-mentioned printing unit according to the one embodiment of the present invention, further includes return mechanism configured to move the movable blade from the cutting position to the standby position through use of an operating force generated along with operation of the operation lever from the lock position toward the unlock position under a state in which the movable blade is stopped at the cutting position before the platen lock mechanism switches the lock arm to the unlock state of unlocking the platen roller.

In the above-mentioned printing unit according to the one embodiment of the present invention, wherein the return mechanism includes: a return rack formed on the drive rack; a return pinion, which meshes with rack teeth of the return rack; a return gear and a sun gear supported so as to be rotatable about the rotation axis of the operation lever under a state of being arranged coaxially with the rotation axis; a planetary gear which meshes with the sun gear, and revolves along with movement of the operation lever; and an internal gear with which the planetary gear meshes, and wherein the return gear is allowed to mesh with the return pinion.

In the above-mentioned printing unit according to the one embodiment of the present invention, wherein the rack teeth are formed on a side opposite to a blade edge of the movable blade so as to mesh with the return pinion when the movable blade is at the cutting position, and to be disengaged from the return pinion when the movable blade is at the standby position.

In the above-mentioned printing unit according to the one embodiment of the present invention, wherein the lock arm includes a disengagement preventing surface, which is straight and configured to prevent disengagement of the at least one of the pair of platen bearings from the receiving groove through the opening when the lock arm is in the lock state, and wherein a line extending from the swing axis of the lock arm and passing through a center of the at least one of the pair of platen bearings, and the disengagement preventing surface cross at right angles.

The above-mentioned printing unit according to the one embodiment of the present invention, further includes a platen support spring configured to assist holding of the at least one of the pair of platen bearings in the receiving groove, wherein the platen support spring allows disengagement of the at least one of the pair of platen bearings from the receiving groove through the opening by being moved in a direction of releasing holding of the at least one of the pair of platen bearings along with movement of the operation lever from the lock position toward the unlock position side before the pushing-up arm pushes the at least one of the pair of platen bearings.

According to one embodiment of the present invention, there is provided a thermal printer, including: the above-mentioned printing unit; a printer main body which includes a recording sheet receiving portion configured to receive the recording sheet, and includes one of the head unit and the platen unit mounted thereto; and a printer cover which is coupled to the printer main body so as to be pivotable, and includes another one of the head unit and the platen unit mounted thereto.

DETAILED DESCRIPTION OF THE PREFERRED EMBODIMENTS

Figure 1:
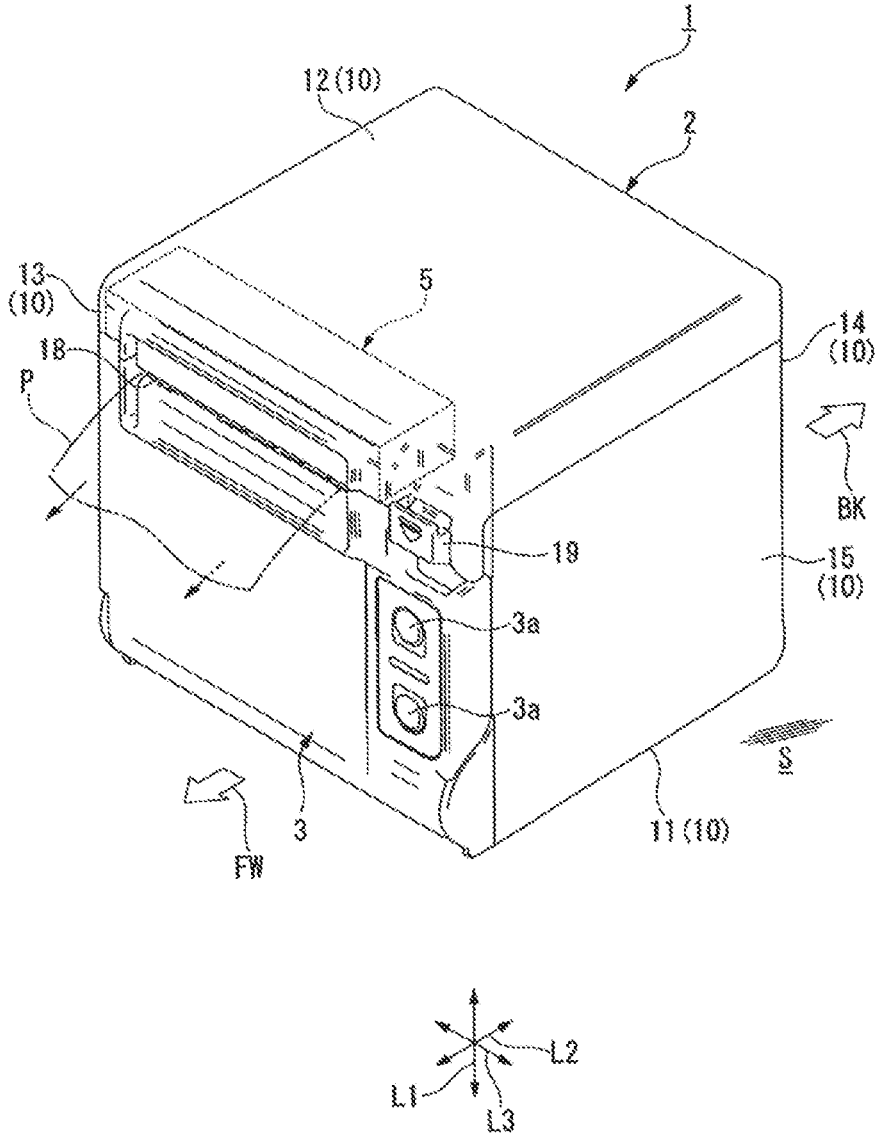
FIG. 1 is a perspective view for illustrating a thermal printer according to an embodiment of the present invention, for illustrating a state in which a printer cover is closed.
Figure 2:
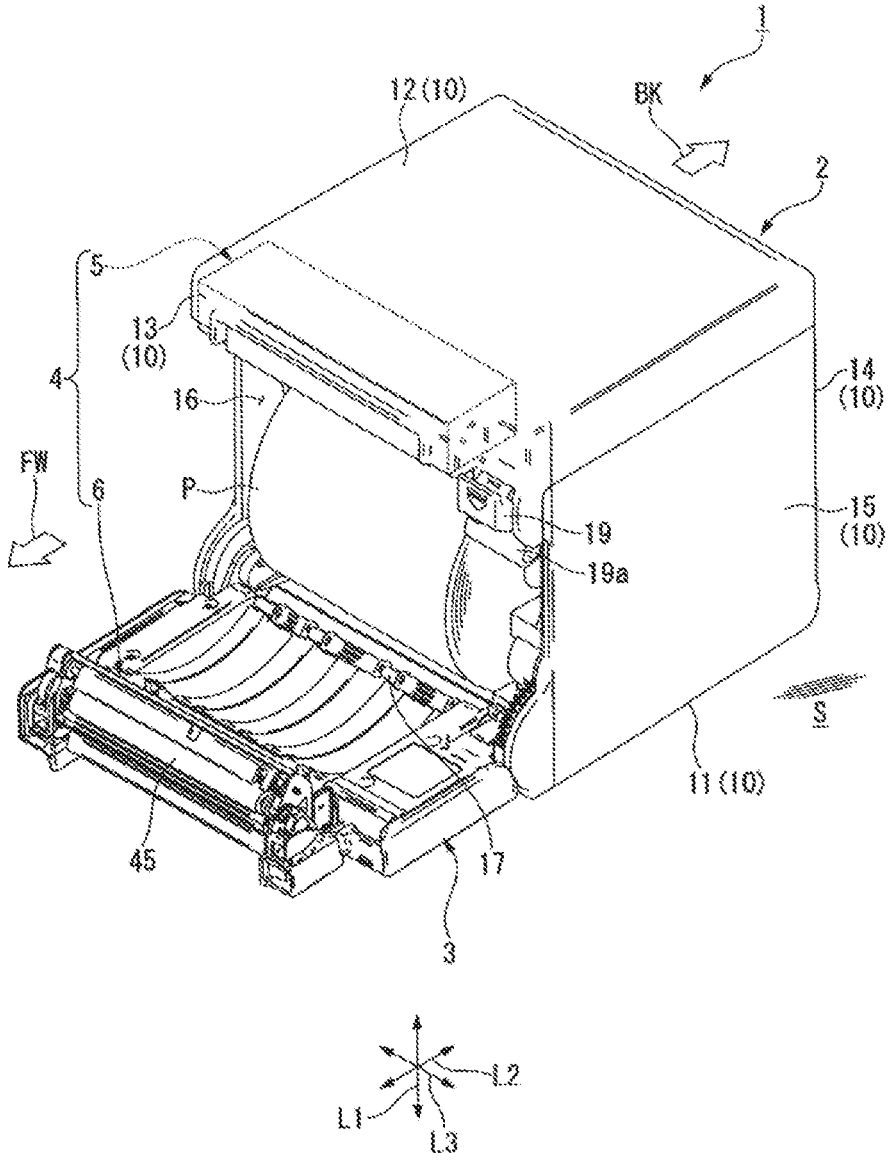
FIG. 2 is a perspective view for illustrating the thermal printer in a state in which the printer cover of FIG. 1 is opened.

Now, one embodiment of the present invention is described with reference to the drawings. As illustrated in FIG. 1 and FIG. 2, a thermal printer 1 is a printer capable of performing printing on a recording sheet (heat-sensitive paper) P having a roll sheet shape so that the recording sheet P is used as, for example, a ticket or a receipt.

The thermal printer 1 is placed on, for example, a store counter, and actions of the thermal printer 1 are controlled by an information processing device (not shown). Accordingly, the thermal printer 1 is controlled so as to perform printing of various kinds of information sent from the information processing device on the recording sheet P, and to deliver the printed recording sheet P.

The thermal printer 1 is placed on, for example, a placement surface S of the store counter, and is formed into a cubic shape as a whole. In this embodiment, when the thermal printer 1 is in a state illustrated in FIG. 1 and FIG. 2, a direction perpendicular to the placement surface S is referred to as an up-and-down direction L1, and directions orthogonal to each other in a plane parallel to the placement surface S are referred to as a front-and-back direction L2 and a right-and-left direction L3. In the front-and-back direction L2, a front side is indicated by the arrow "FW", and a back side is indicated by the arrow "BK". Therefore, in FIG. 1 and FIG. 2, a lower left side of the drawing sheet is defined as a front side FW, and an upper right side of the drawing sheet is defined as a back side BK.

The thermal printer 1 includes a casing (printer main body according to the present invention) 2, a printer cover 3, and a printing unit 4 including a head unit 5 and a platen unit 6. The thermal printer 1 is of a so-called front delivery type in which the recording sheet P is delivered to the front side FW. In the illustrated example, the platen unit 6 is provided on the printer cover 3 side, and the head unit 5 is provided on the casing 2 side. However, the present invention is not limited to this case. For example, the head unit 5 may be provided on the printer cover 3 side, and the platen unit 6 may be provided on the casing 2 side.

The casing 2 is made of a synthetic resin material, a metal material, or a combination of those materials, and thus is formed into a cubic shape having an opening portion on the front side FW. The casing 2 includes a plurality of outer surfaces 10 that include a bottom surface 11 arranged so as to be opposed to the placement surface S. However, the shape of the casing 2 is not limited to this case, and may be modified as appropriate.

Of the plurality of outer surfaces 10, the outer surface 10 opposed to the bottom surface 11 in the up-and-down direction L1 is referred to as "top surface 12". In addition, of the plurality of outer surfaces 10, the outer surface 10 positioned on the front side FW is referred to as "front surface 13", and the outer surface 10 positioned on the back side BK is referred to as "back surface 14". The front surface 13 and the back surface 14 are opposed to each other in the front-and-back direction L2. Further, of the plurality of outer surfaces 10, the outer surfaces 10 opposed to each other in the right-and-left direction L3 are referred to as "pair of side surfaces 15".

Inside the casing 2, a recording sheet receiving portion 16 is formed. In the recording sheet receiving portion 16, the recording sheet P having a roll shape can be received through the opening portion formed in the front surface 13 of the casing 2. With this configuration, when the printer cover 3 is opened, the recording sheet P having a roll shape can be loaded into the recording sheet receiving portion 16 from the front side FW.

The printer cover 3 is coupled to a lower part of the casing 2 on the front surface 13 side through intermediation of a rotary shaft portion 17, and is configured to openably cover the opening portion. The printer cover 3 is coupled to the lower part of the casing 2 on the front surface 13 side so as to be rotated about the rotary shaft portion 17 within an angle range of about 90°. As illustrated in FIG. 1, when the printer cover 3 is closed, a slight gap is designed to be formed between a distal end of the printer cover 3 and the casing 2. The recording paper P is pulled out to the front side FW to be delivered from an inside of the casing 2 through the gap. Thus, the gap serves as a delivery slot 18 for the recording paper P.

When the printer cover 3 is closed, the casing 2 and the printer cover 3 configured as described above are locked along with combination between the platen unit 6 and the head unit 5. Thus, the printer cover 3 is locked in a closed state.

Moreover, as illustrated in FIG. 1, on the casing 2, at a corner portion at which the front surface 13, the top surface 12, and one of the side surfaces 15 meet, an operation lever 19 is provided. The operation lever 19 is configured to release the combination (locking) between the platen unit 6 and the head unit 5. With this configuration, as illustrated in FIG. 2, locking of the printer cover 3 can also be released, thereby being capable of performing opening operation of the printer cover 3. The operation lever 19 can be operated to be pushed, for example, downward.

The printer cover 3 includes, for example, a power button and operation buttons 3*a* provided as sheet feeding buttons. The operation buttons 3*a* are arranged on an outer surface of the printer cover 3 under a state of being exposed in a pressable manner. In the illustrated example, the operation buttons 3*a* are arranged below the operation lever 19 so as to be aligned with each other in the up-and-down direction L.

As illustrated in FIG. 2 to FIG. 5, the printing unit 4 includes the head unit 5, which is provided on the casing 2 side, and the platen unit 6, which is provided on the printer cover 3 side so as to be detachably combined with the head unit 5.

The head unit 5 includes a head frame 20, a head cover plate 21, and gear covers 22 and 23. The head frame 20 is made of, for example, a synthetic resin, and forms a basic framework of the head unit 5. The head cover plate 21 is made of, for example, a metal, and is combined with the head frame 20 so as to cover the head frame 20 from the front side FW and the right-and-left direction L3. The gear covers 22 and 23 are each made of, for example, a metal, and are combined with the head frame 20 so as to cover the head frame 20 from the right-and-left direction L3.

The head unit 5 further includes at least a thermal head 25, a movable blade 26, a drive mechanism 27, an operation lever 28, a return mechanism 29, and a platen lock mechanism 30. The thermal head 25, the movable blade 26, the drive mechanism 27, the operation lever 28, the return mechanism 29, and the platen lock mechanism 30 are mounted mainly through use of the head frame 20, and are covered with the head cover plate 21 and the gear covers 22 and 23.

The head unit 5 configured as described above is mounted to an interior of the casing 2. Specifically, the head unit 5 is arranged above the recording sheet receiving portion 16 and at a position close to the front surface 13 of the casing 2, and is mounted to the casing 2 mainly by fastening the head frame 20 with screws. In this embodiment, the head unit 5 is mounted such that a blade edge 26*a* of the movable blade 26 is directed downward. The head unit 5 is described later in detail.

The platen unit 6 includes a platen frame 40 and a platen cover plate 41. The platen frame 40 is made of, for example, a synthetic resin, and forms a basic framework of the platen unit 6. The platen cover plate 41 is made of, for example, a metal, and is combined with the platen frame 40 so as to cover the platen frame 40 from the front side FW and the right-and-left direction L3. The platen unit 6 further includes at least a platen roller 45 and a fixed blade 46. The platen roller 45 and the fixed blade 46 are mounted mainly through use of the platen frame 40, and are covered with the platen cover plate 41.

The platen unit 6 configured as described above is mounted to an inner surface of the printer cover 3 mainly through the platen cover plate 41. At this time, the platen unit 6 is mounted at a position at which the platen unit 6 is detachably combined with the head unit 5 along with an opening and closing operation of the printer cover 3. In this embodiment, the platen unit 6 is mounted such that a blade edge 46*a* of the fixed blade 46 is directed upward.

The platen unit 6 is described in detail. As illustrated in FIG. 3 to FIG. 6, when the head unit 5 and the platen unit 6 are combined with each other, the fixed blade 46 is supported by the platen frame 40 such that the blade edge 46*a* is directed toward the head unit 5 side. As illustrated in FIG. 6, in the platen frame 40, at a position more on the back side BK than the fixed blade 46, a platen receiving space 47 configured to receive the platen roller 45 is formed. Further, the platen frame 40 includes support walls 48, which are configured to support the platen roller 45 and are arranged so as to face each other in the right-and-left direction L3 across the platen receiving space 47.

The platen roller 45 is a rubber roller configured to convey the recording sheet P to an outside of the printer cover 3, and includes a rubber layer formed on a platen shaft 50 extending in the right-and-left direction L3. The platen roller 45 is received in the platen receiving space 47 under a state in which a part of an outer peripheral surface of the platen roller 45 is exposed to the head unit 5 side, and is supported by the support walls 48 so as to be rotatable. Specifically, platen bearings 51 each having a cylindrical shape are respectively fitted on both end portions of the platen shaft 50 extending more toward an outer side in the right-and-left direction L3 than the platen roller 45. With this configuration, even when the pair of platen bearings 51 is pressed down, the platen roller 45 can be rotated. A driven gear 52 is fixed to one end portion of the platen shaft 50 located more on the outer side in the right-and-left direction L3 than the platen bearing 51.

The support walls 48 fix the platen bearings 51 in a holding manner through use of, for example, slit holes. With this configuration, the platen roller 45 is supported by the pair of support walls 48 through intermediation of the pair of platen bearings 51 so as to be rotatable under a state in which the platen roller 45 is received in the platen receiving space 47. The pair of platen bearings 51 extends more toward the outer side in the right-and-left direction L3 than the support walls 48. When the printer cover 3 is closed, as illustrated in FIG. 5, the pair of platen bearings 51 is respectively received in a pair of receiving grooves 62 formed on the head unit 5 side.

Figure 5:
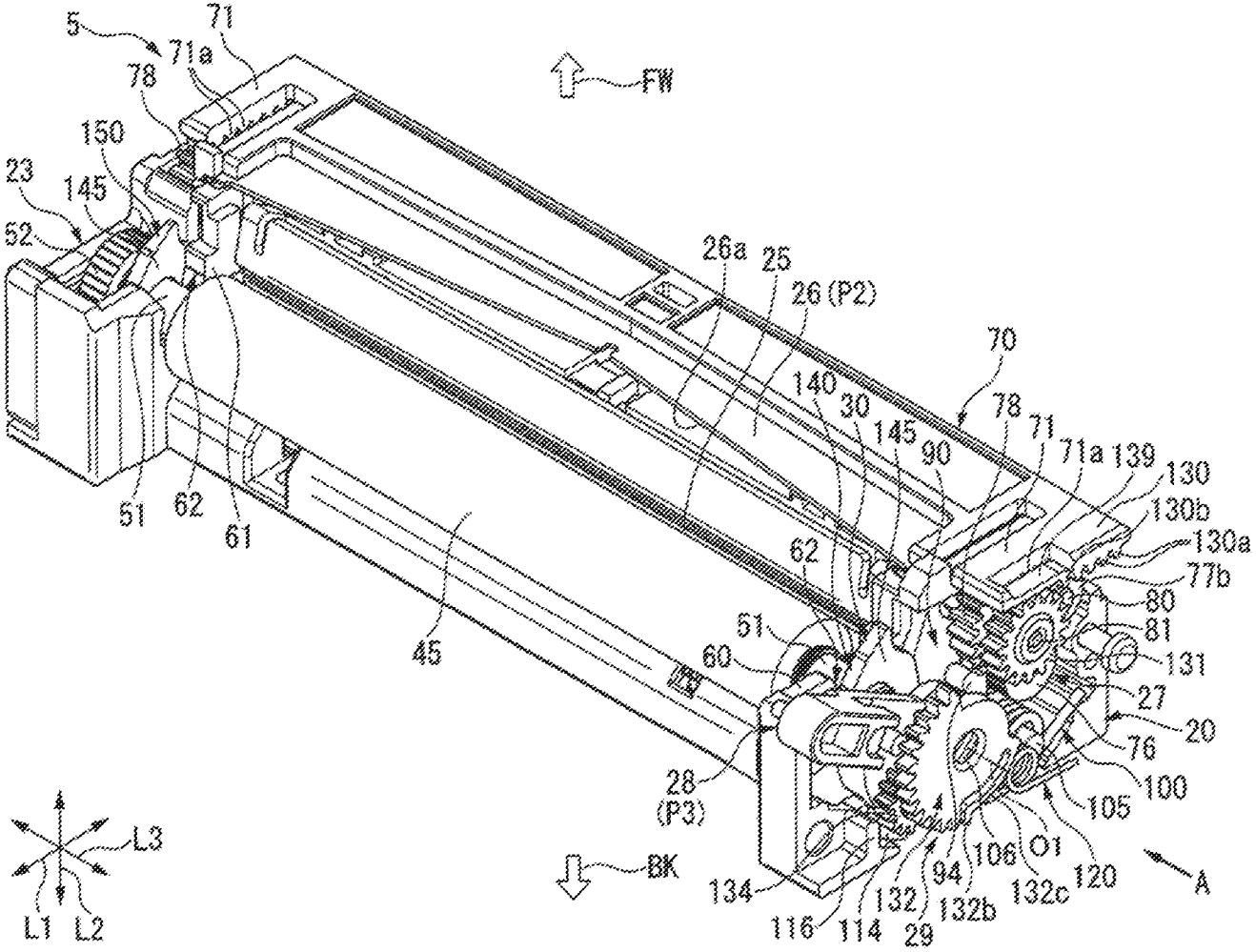
FIG. 5 is a perspective view for illustrating the printing unit in a state in which a platen frame and other components are removed from the state illustrated in FIG. 4.
Figure 6:
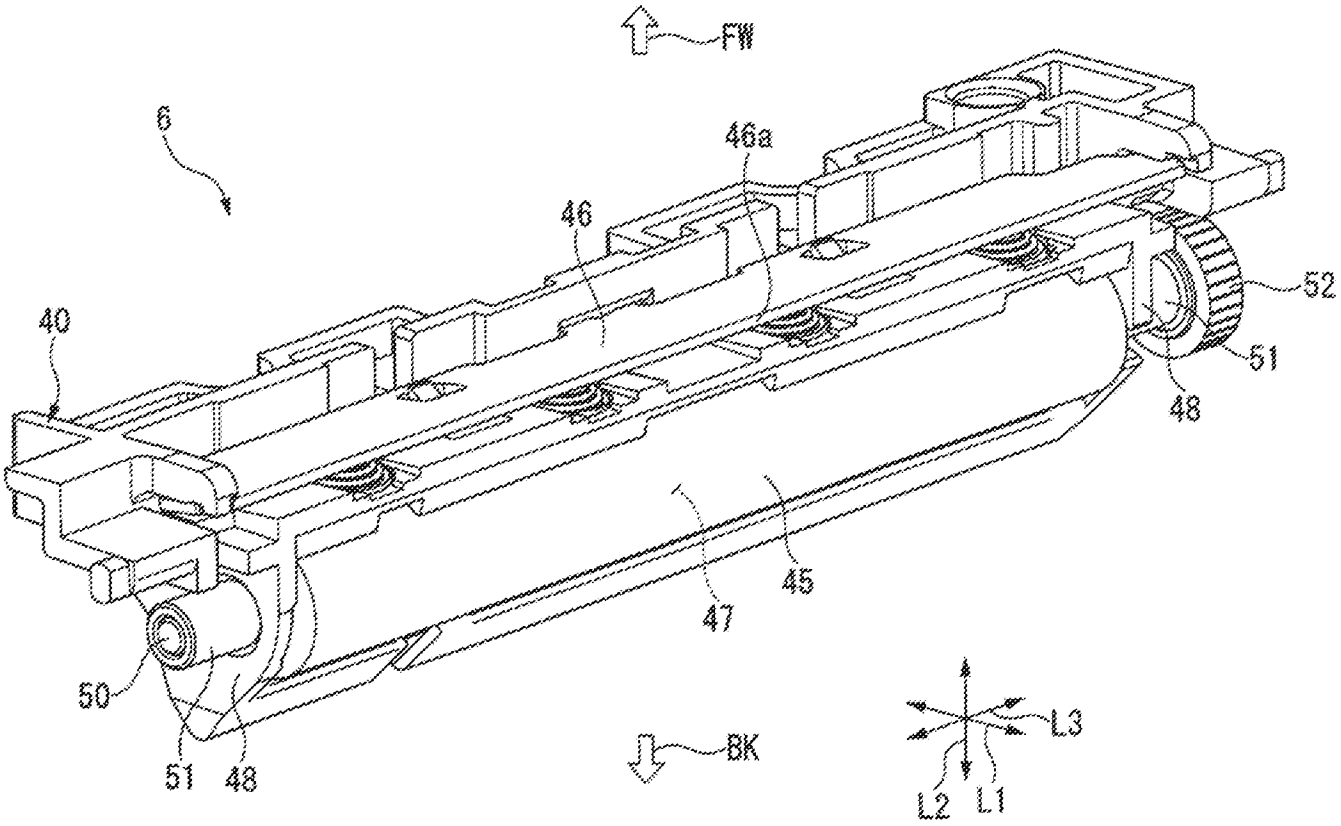
FIG. 6 is a perspective view for illustrating a platen unit of FIG. 4.

In FIG. 5, the platen roller 45 and the platen bearings 51 of the platen unit 6 are mainly illustrated.

Figure 3:
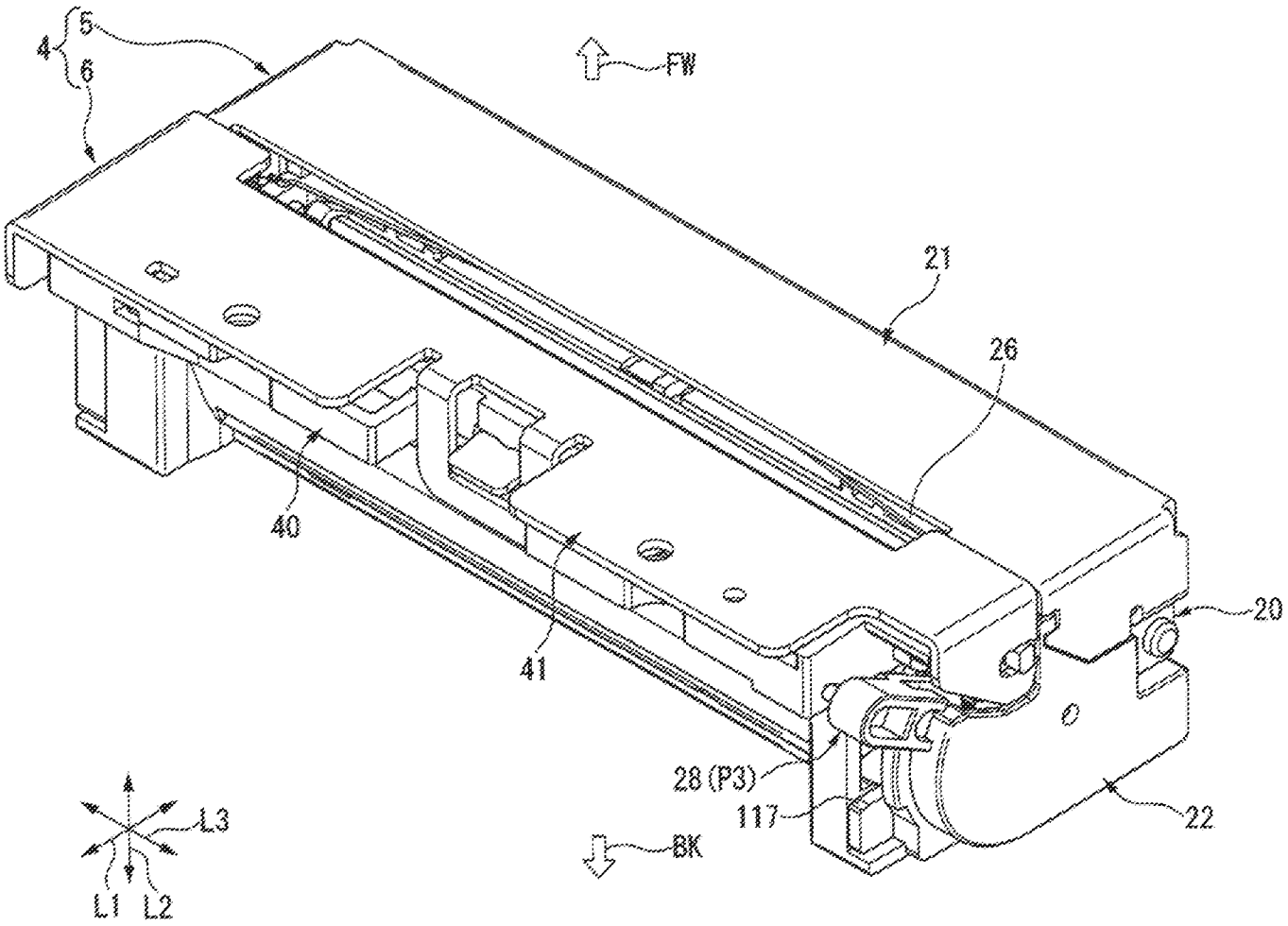
FIG. 3 is a perspective view for illustrating a printing unit of FIG. 2.
Figure 4:
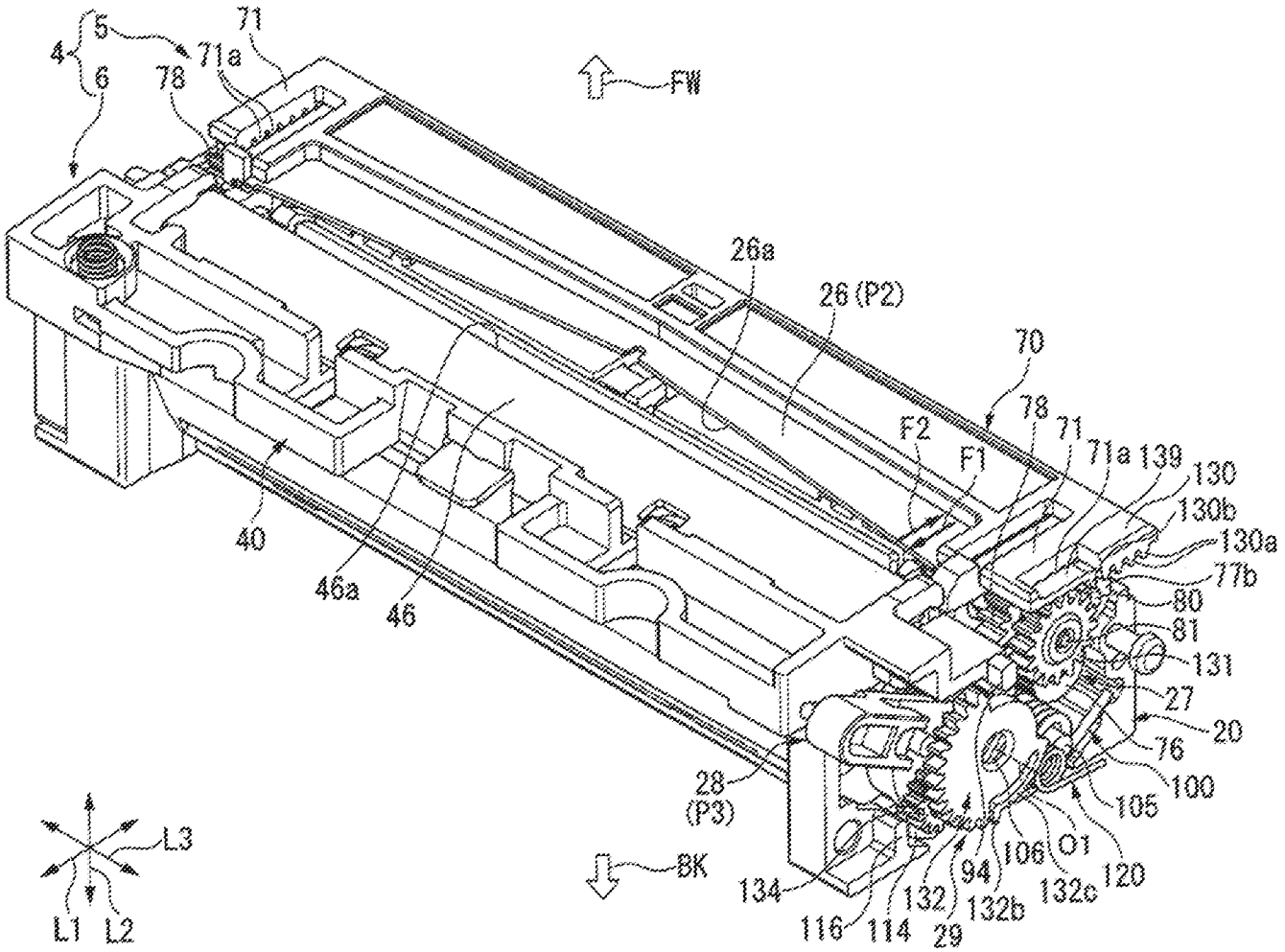
FIG. 4 is a perspective view for illustrating the printing unit in a state in which gear covers and other components are removed from the state illustrated in FIG. 3.

Next, the head unit 5 is described in detail. As illustrated in FIG. 3 to FIG. 5, the head unit 5 includes at least the thermal head 25, the movable blade 26, the drive mechanism 27, the operation lever 28, the return mechanism 29, and the platen lock mechanism 30.

As illustrated in FIG. 5, the thermal head 25 includes a plurality of heating elements (not shown) arrayed in line along the right-and-left direction L3. The thermal head 25 is mounted to the head frame 20 so as to be opposed to the platen roller 45 when the printer cover 3 is at a closed position. The recording sheet P is allowed to pass through between the platen roller 45 and the thermal head 25. A coil spring (not shown) configured to urge the thermal head 25 toward the platen roller 45 side is interposed between the thermal head 25 and the head frame 20. With this configuration, the thermal head 25 can be reliably pressed against the recording sheet P fed by the platen roller 45, and hence the printing unit 4 can perform satisfactory printing.

Figure 7:
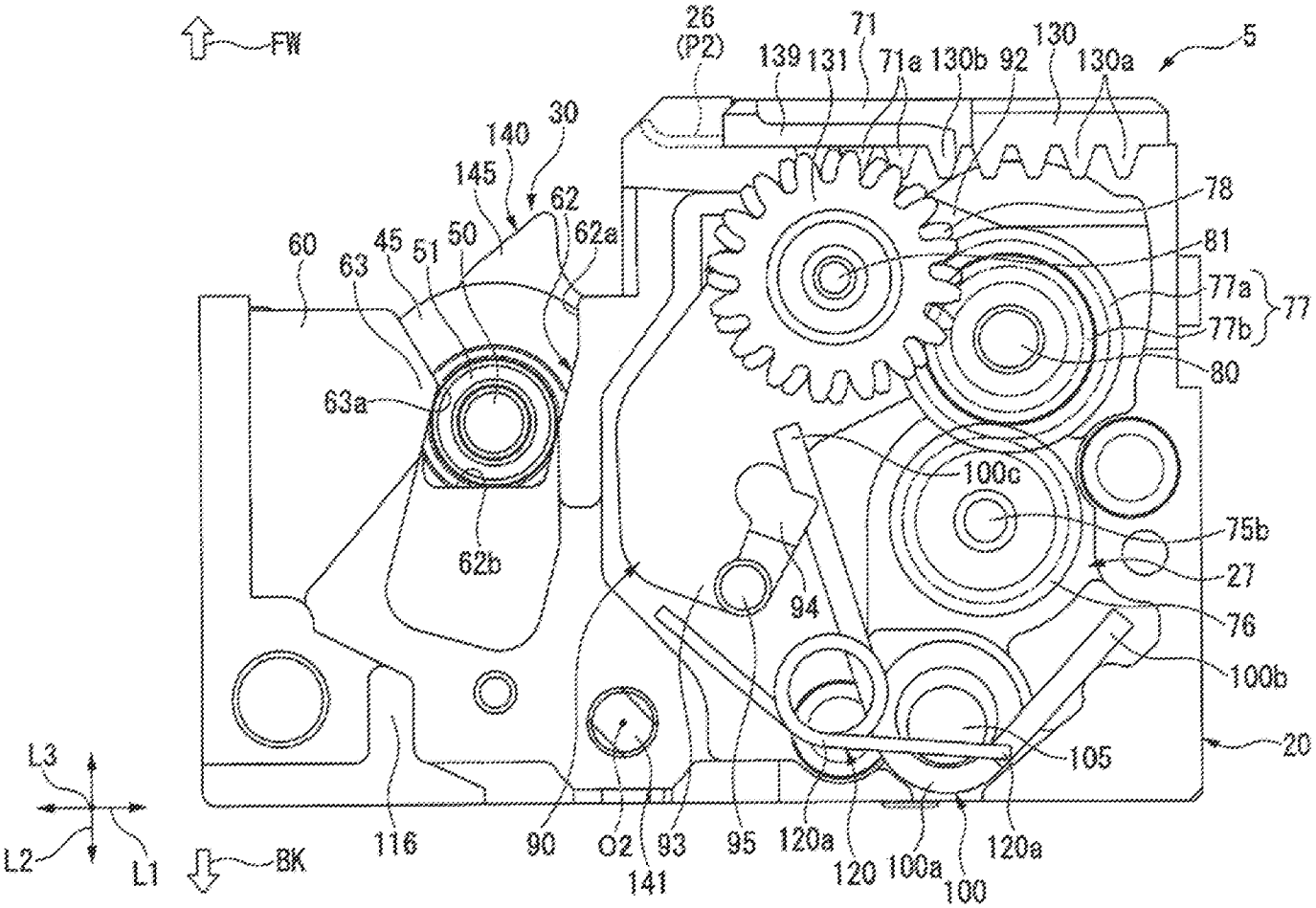
FIG. 7 is a side view seen from a direction indicated by the arrow "A" of FIG. 5, for illustrating a relationship between a receiving groove and a platen bearing.

The head frame 20 includes a pair of side wall portions 60 and 61 located more on the outer side in the right-and-left direction L3 than the support walls 48 of the platen frame 40 of the platen unit 6. The pair of receiving grooves 62 in which the pair of platen bearings 51 can be fitted individually is formed in the pair of side wall portions 60 and 61, respectively. As illustrated in FIG. 7, each of the receiving grooves 62 has a U shape in side view, and has an opening 62*a* opened to the front side FW so as to face the platen unit 6 side. A groove bottom portion 62*b* of each of the receiving grooves 62 is flat. FIG. 7 is an illustration of the receiving groove 62 formed in one side wall portion 60, and illustrations of other components are omitted as appropriate.

On an inner surface of the receiving groove 62, an inclined guide protrusion 63 configured to guide the platen bearing 51 toward the groove bottom portion 62*b* side is formed so as to decrease an opening width from the opening 62*a* side toward the groove bottom portion 62*b* side. With this configuration, the receiving groove 62 is formed so that the opening width is largest at the opening 62*a* and the opening width is smallest in the vicinity of an apex portion 63*a* of the guide protrusion 63. When the guide protrusion 63 is formed on the receiving groove 62, the platen bearing 51 can be guided along the guide protrusion 63 so as to sink toward the groove bottom portion 62*b* side.

As described above, the receiving grooves 62 are formed in the pair of side wall portions 60 and 61, respectively. Accordingly, when the head unit 5 and the platen unit 6 are combined with each other, as illustrated in FIG. 5 and FIG. 7, the pair of platen bearings 51 is fitted and received in the pair of receiving grooves 62, respectively. At this time, the platen bearings 51 are received in the receiving grooves 62 in contact with the groove bottom portions 62*b*.

Figure 8:
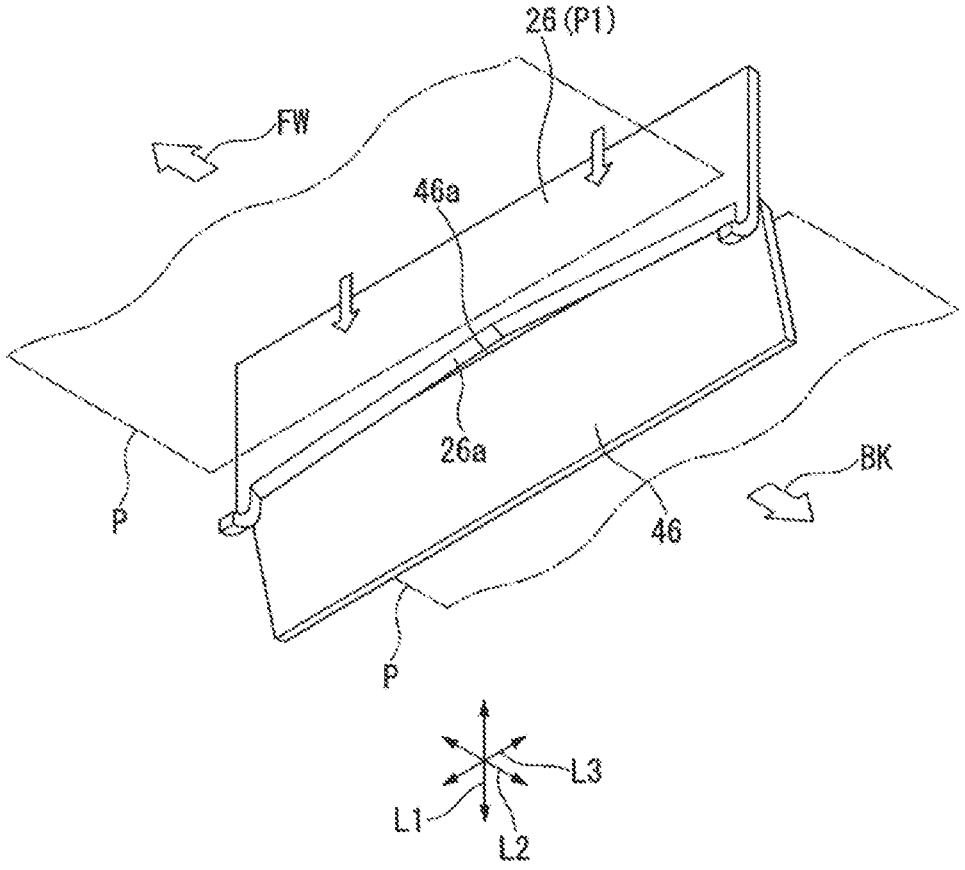
FIG. 8 is a perspective view for illustrating a state in which a recording sheet is cut between a fixed blade and a movable blade.

As illustrated in FIG. 4, the movable blade 26 is mounted to the head frame 20 through intermediation of the drive mechanism 27 so that the blade edge 26*a* is directed toward the platen unit 6 side when the head unit 5 and the platen unit 6 are combined with each other. At this time, the movable blade 26 is arranged so as to face the fixed blade 46 in the up-and-down direction L1, and is arranged so as to overlap the fixed blade 46 in the front-and-back direction L2 when being moved to a cutting position P1. As illustrated in FIG. 8, the movable blade 26 is a plate-like blade formed to have a V shape so that a length from a blade base to the blade edge 26*a* gradually decreases from both ends to a center of the movable blade 26. FIG. 8 is a perspective view for illustrating a state in which the movable blade 26 is moved to the cutting position P1 to cut the recording sheet P between the fixed blade 46 and the movable blade 26.

As illustrated in FIG. 4, the movable blade 26 is mounted to a drive rack 71 of the drive mechanism 27 through intermediation of a movable blade holder 70. The movable blade 26 is configured so as to be movable relative to the head frame 20 in the up-and-down direction L1 through actions of the drive mechanism 27. Thus, the movable blade 26 is supported so as to be movable relative to the fixed blade 46 in the up-and-down direction LL.

Figure 9:
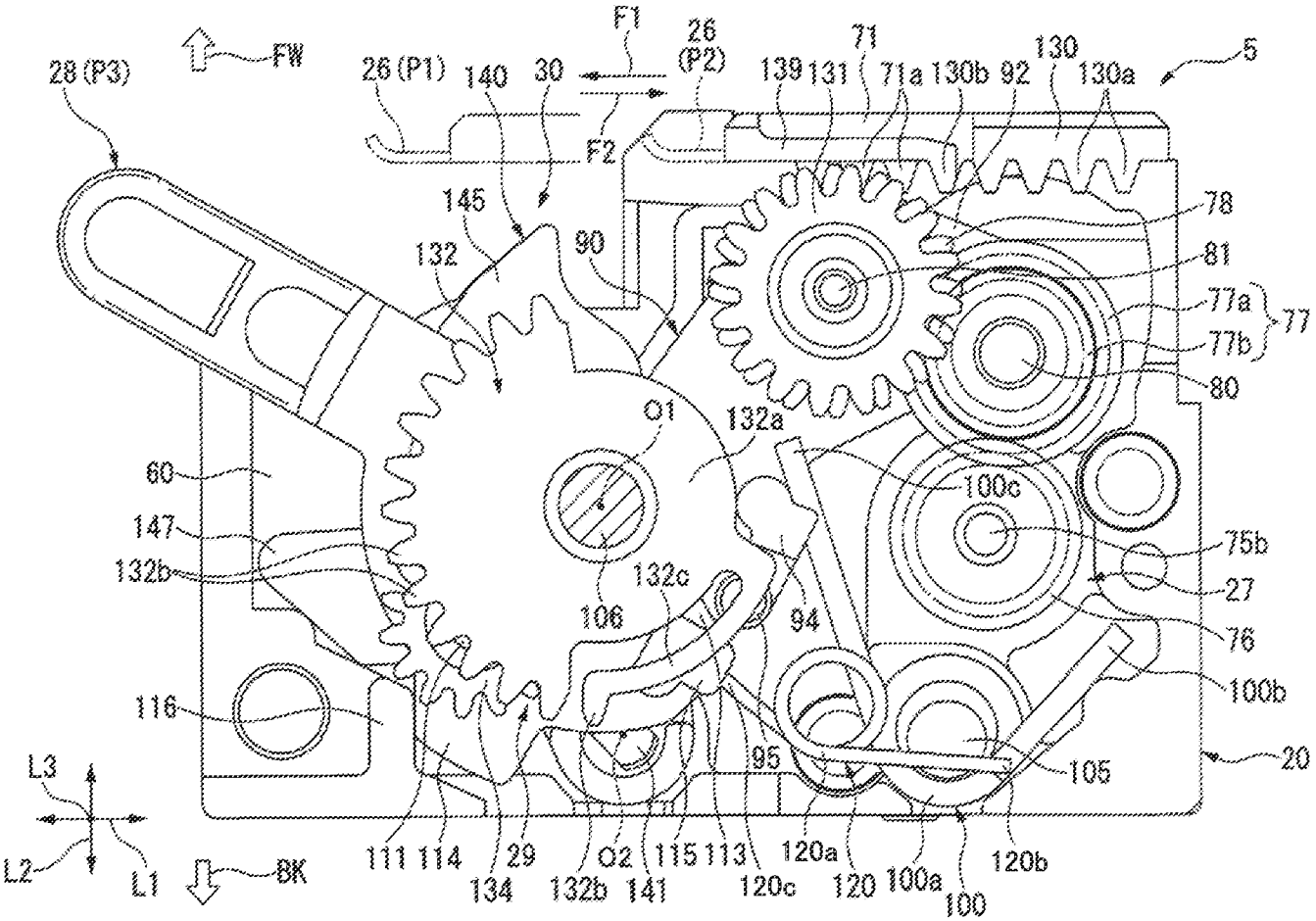
FIG. 9 is a side view seen from the direction indicated by the arrow "A" of FIG. 5.
Figure 10:
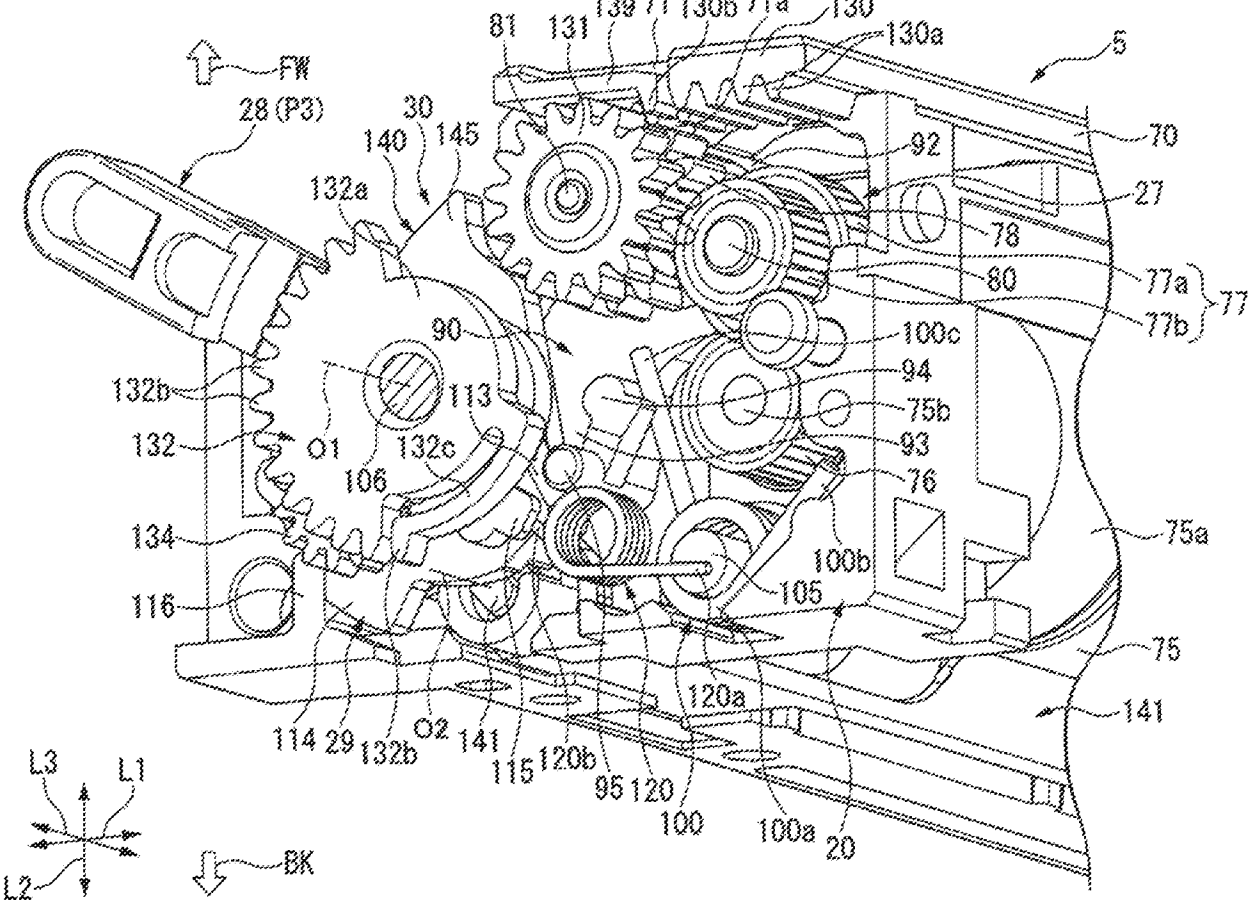
FIG. 10 is a perspective view for illustrating mechanisms of FIG. 9.

As illustrated in FIG. 4, FIG. 9, and FIG. 10, the drive mechanism 27 is a mechanism configured to move the movable blade 26 between the cutting position P1 and a standby position P2. The cutting position P1 is a position at which the movable blade 26 cuts the recording sheet P together with the fixed blade 46 by climbing over the fixed blade 46 (see FIG. 8). The standby position P2 is a position at which the movable blade 26 is suitably away from the fixed blade 46 (see FIG. 4). The drive mechanism 27 includes a driving motor 75, a drive intermediate wheel 76, a double intermediate wheel 77, a drive pinion 78, and the drive rack 71.

As illustrated in FIG. 10, the driving motor 75 is a motor that is rotatable in forward and reverse directions, and is fixed to an inner side of the one side wall portion 60 of the head frame 20. A drive shaft of the driving motor 75 is connected to a speed reduction mechanism 75*a*. Moreover, an output shaft 75*b* of the speed reduction mechanism 75*a* protrudes more toward the outer side in the right-and-left direction L3 than the one side wall portion 60 of the head frame 20. The drive intermediate wheel 76 is arranged on the outer side in the right-and-left direction L3 than the one side wall portion 60, and is coupled to the output shaft 75*b* of the speed reduction mechanism 75*a*. Therefore, the drive intermediate wheel 76 is rotated along with rotation of the driving motor 75 transmitted through the speed reduction mechanism 75*a*.

As illustrated in FIG. 9 and FIG. 10, the double intermediate wheel 77 is arranged between the drive intermediate wheel 76 and the drive pinion 78, and is supported on an intermediate support shaft 80 so as to be rotatable. The double intermediate wheel 77 includes a large-diameter intermediate wheel 77*a* and a small-diameter intermediate wheel 77*b* having a diameter smaller than that of the large-diameter intermediate wheel 77*a*. The large-diameter intermediate wheel 77*a* meshes with the drive intermediate wheel 76 when the operation lever 28 is at a lock position P3. Thus, the entire double intermediate wheel 77 is rotated along with rotation of the drive intermediate wheel 76. The small-diameter intermediate wheel 77*b* is arranged more on the outer side in the right-and-left direction L3 than the large-diameter intermediate wheel 77*a*, and meshes with the drive pinion 78.

The drive pinion 78 is arranged so as to be located more on the operation lever 28 side than the small-diameter intermediate wheel 77*b* and located on the drive rack 71 side, and is fixed to a pinion support shaft 81 under a state of being arranged coaxially with the pinion support shaft 81. With this configuration, the drive pinion 78 and the pinion support shaft 81 are rotated integrally. Further, the drive pinion 78 meshes with the small-diameter intermediate wheel 77*b*, and meshes with drive rack teeth 71*a* of the drive rack 71.

As illustrated in FIG. 4, the drive rack 71 is arranged not only on the one side wall portion 60 side of the head frame 20 but also on another side wall portion 61 side thereof. That is, the drive racks 71 are arranged on both sides of the head frame 20 in the right-and-left direction L3, respectively while holding the head frame 20. The pinion support shaft 81 is formed so as to pass through the head frame 20 in the right-and-left direction L3, and couples the pair of drive pinions 78 arranged on the both sides of the head frame 20 in the right-and-left direction L3, respectively. With this configuration, the pair of drive pinions 78 can be rotated together in a synchronized state through the pinion support shaft 81.

The drive racks 71 are mounted to both end portions of the movable blade holder 70 in the right-and-left direction L3 so as to extend in the up-and-down direction L1. With this configuration, the drive racks 71 are combined with the movable blade 26 through intermediation of the movable blade holder 70. The drive rack teeth 71*a* are formed in an entire region of each of the drive racks 71. The pair of drive pinions 78 meshes with the drive rack teeth 71*a*. Therefore, along with rotation of the pair of drive pinions 78, the movable blade 26 can be moved between the standby position P2 and the cutting position P1 through the drive racks 71.

In the following, for ease of understanding of the configuration, the drive pinion 78 and the drive rack 71, which are located on the one side wall portion 60 side (driving motor 75 side), are described in detail. Description of the drive pinion 78 and the drive rack 71, which are located on the another side wall portion 61 side, is omitted.

The drive mechanism 27 is configured as described above, and hence as illustrated in FIG. 4 and FIG. 9, the drive pinion 78 can be rotated along with rotation of the driving motor 75 through the drive intermediate wheel 76 and the double intermediate wheel 77 (including the large-diameter intermediate wheel 77*a* and the small-diameter intermediate wheel 77*b*). Accordingly, the drive rack 71 can be moved in a direction indicated by the arrow "F1" together with a return rack 130 of the return mechanism 29 to be described later, thereby being capable of moving the movable blade 26 in the same direction as the direction indicated by the arrow "F1". Thus, the movable blade 26 can be moved from the standby position P2 to the cutting position P1.

Meanwhile, when the driving motor 75 is rotated reversely, the drive pinion 78 can be rotated reversely through the drive intermediate wheel 76 and the double intermediate wheel 77. Accordingly, the drive rack 71 can be moved in a direction indicated by the arrow "F2" together with the return rack 130, thereby being capable of moving the movable blade 26 in the same direction as the direction indicated by the arrow "F2". Thus, the movable blade 26 can be moved and returned from the cutting position P1 to the standby position P2.

Incidentally, the intermediate support shaft 80 configured to support the double intermediate wheel 77 described above is fixed to a swing plate 90 arranged so as to be swingable about the pinion support shaft 81. As illustrated in FIG. 7 and FIG. 9 to FIG. 11, the swing plate 90 has an insertion hole 91 formed to pass through the swing plate 90 in the right-and-left direction L3 and configured to allow the pinion support shaft 81 to be inserted therethrough. Under a state in which the swing plate 90 allows the pinion support shaft 81 to be inserted through the insertion hole 91, the swing plate 90 is arranged along a wall surface of the one side wall portion 60 so as to be swingable.

The swing plate 90 includes a first plate portion 92 and a second plate portion 93. The first plate portion 92 extends from the insertion hole 91 toward a space between the drive intermediate wheel 76 and the drive rack 71. The second plate portion 93 extends from the insertion hole 91 toward a swing axis O2 of a lock arm 140 to be described later.

The intermediate support shaft 80 is formed so as to extend from the first plate portion 92 toward the outer side in the right-and-left direction L3. With this configuration, the double intermediate wheel 77 supported on the intermediate support shaft 80 is swingable about the pinion support shaft 81 along with swing of the swing plate 90. The second plate portion 93 includes a locking protrusion 94 and an engagement pin 95 formed so as to protrude toward the outer side in the right-and-left direction L3.

By an urging force of a first urging member 100, the swing plate 90 thus configured is always urged in such a direction that the large-diameter intermediate wheel 77*a* of the double intermediate wheel 77 meshes with the drive intermediate wheel 76. The first urging member 100 is, for example, a coil spring, and includes a coil portion 100*a*, a first coil end portion 100*b*, and a second coil end portion 100*c*. The coil portion 100*a* is supported on a coil support shaft 105 formed on the one side wall portion 60 so as to protrude. The first coil end portion 100*b* is locked to the head frame 20. The second coil end portion 100*c* is locked to the locking protrusion 94 of the swing plate 90.

Thus, the second plate portion 93 of the swing plate 90 is urged toward the operation lever 28 side by the urging force (elastic restoration force) of the first urging member 100, and hence the large-diameter intermediate wheel 77*a* is positioned under a state of being pressed against the drive intermediate wheel 76. The first urging member 100 is not limited to a coil spring, and may be formed of, for example, a plate spring.

Further, when the engagement pin 95 is pushed up by a pushing-up cam 113 to be described later along with operation of the operation lever 28, the swing plate 90 is swung about the pinion support shaft 81 against the urging force of the first urging member 100 so that the double intermediate wheel 77 is moved away from the drive intermediate wheel 76. Thus, meshing between the double intermediate wheel 77 and the drive intermediate wheel 76 can be released.

As illustrated in FIG. 4, FIG. 9, and FIG. 10, the operation lever 28 is arranged on the one side wall portion 60 side of the head frame 20, and is supported on a lever support shaft 106 so as to be rotatable. The operation lever 28 can be operated to be pushed in and rotated about the lever support shaft 106 from the lock position P3 toward a meshing release position P4 or an unlock position P5 to be described later in a counterclockwise direction in side view in which the one side wall portion 60 is seen from the outer side in the right-and-left direction L3.

Figure 11:
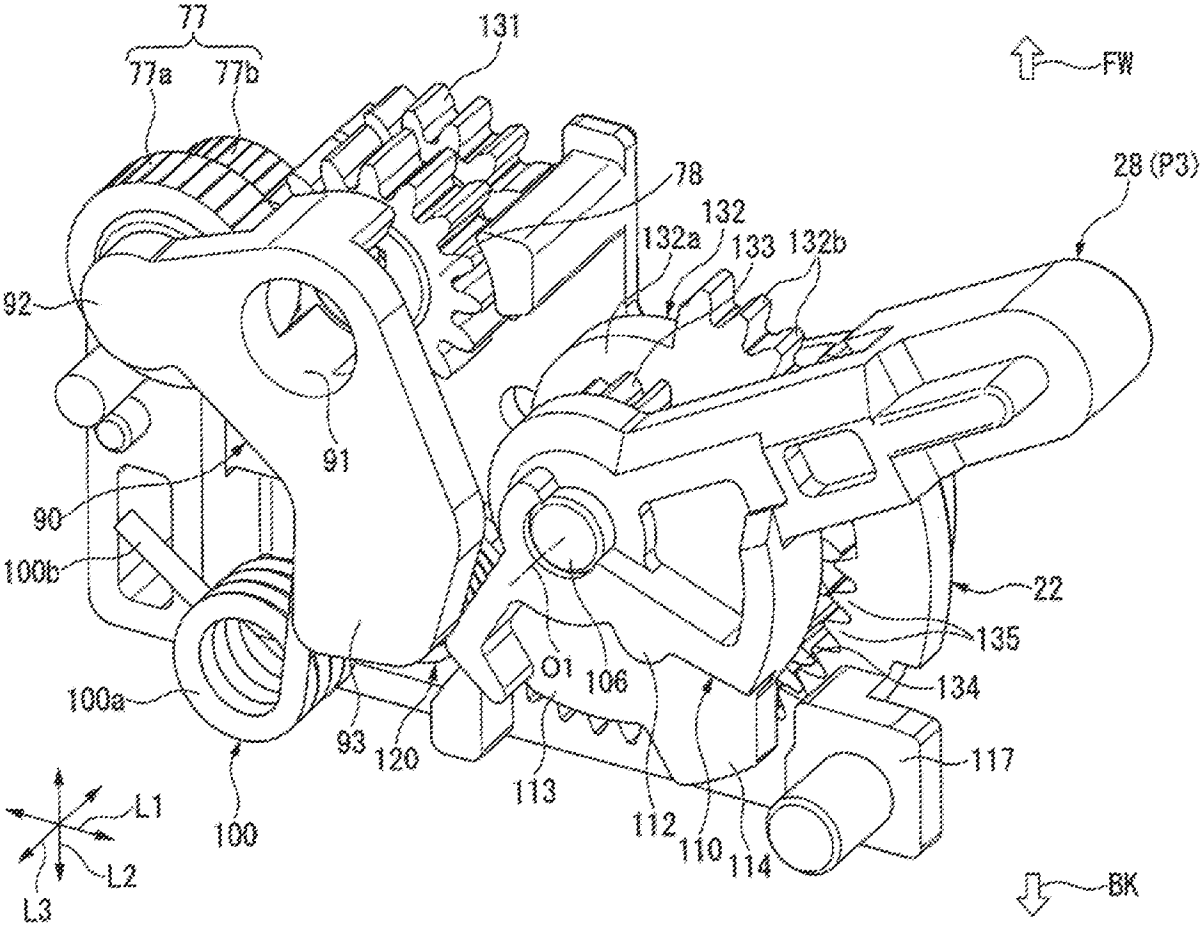
FIG. 11 is a perspective view for illustrating a periphery of an operation lever of FIG. 10 when seen from a side opposite to the viewpoint of FIG. 10.

As illustrated in FIG. 11, the lever support shaft 106 is provided so as to protrude from an inner surface of the gear cover 22 toward the one side wall portion 60 side. A center axis of the lever support shaft 106 matches with a rotation axis O1 of the operation lever 28.

The lock position P3 refers to a position at which the platen unit 6 is retained so as to be locked to the head unit 5. The meshing release position P4 refers to a position at which meshing between the large-diameter intermediate wheel 77*a* of the double intermediate wheel 77 and the drive intermediate wheel 76 is released after the swing plate 90 is swung by the pushing-up cam 113 of the operation lever 28 to be described later. The unlock position P5 refers to a position at which locking of the platen unit 6 to the head unit 5 is released.

As illustrated in FIG. 9 to FIG. 11, a lever plate 110 is formed at a proximal end portion of the operation lever 28 so as to have a fan shape in side view. A planetary shaft 111 is provided on an outer surface of the lever plate 110 so as to protrude toward the outer side in the right-and-left direction L3. A lever projecting portion 112 is formed on an inner surface of the lever plate 110 so as to be engaged with the lock arm 140 to be described later. Moreover, the lever plate 110 includes the pushing-up cam 113 and a projecting regulation piece 114 that protrude toward a radially outer side of the lever plate 110.

The planetary shaft 111 is formed at a position of being offset from the lever support shaft 106. The pushing-up cam 113 is arranged more on a clockwise direction side than the engagement pin 95 formed on the swing plate 90. When the operation lever 28 is rotated from the lock position P3 toward the unlock position P5 side, the planetary shaft 111 can be brought into contact with the engagement pin 95. Moreover, a locking protrusion 115 is formed on an outer surface of the pushing-up cam 113 so as to protrude toward the outer side in the right-and-left direction L3.

The projecting regulation piece 114 is arranged more on the clockwise direction side than the pushing-up cam 113, and is brought into contact with a regulation wall portion 116 of the head frame 20 from the counterclockwise direction side when the operation lever 28 is at the lock position P3. Accordingly, the entire operation lever 28 is restrained from being further rotated in the clockwise direction, and thus the operation lever 28 is positioned at the lock position P3. When the operation lever 28 is moved to the unlock position P5 and is operated to be further pushed, the operation lever 28 can be brought into contact with a regulation wall portion 117 of the gear cover 22 illustrated in FIG. 3 and FIG. 11 from the clockwise direction side. Therefore, the operation lever 28 is restrained from being operated to be further pushed beyond the unlock position P5.

A distal end portion of the operation lever 28 is fitted to an inner side of a coupling member 19*a* (see FIG. 2) of the operation lever 19 provided on the casing 2. Accordingly, the operation lever 28 is operated in synchronization with operation of the operation lever 19. Thus, through the operation of the operation lever 19, the operation lever 28 can be operated from the lock position P3 toward the unlock position P5 in synchronization with the operation of the operation lever 19.

As illustrated in FIG. 9 and FIG. 10, by an urging force of a second urging member 120, the operation lever 28 configured as described above is always urged in a direction (clockwise direction) of being moved toward the lock position P3. The second urging member 120 is, for example, a coil spring, and includes a coil portion 120*a*, a first coil end portion 120*b*, and a second coil end portion 120*c*. The coil portion 120*a* is supported on a coil support shaft (not shown) provided on the inner surface of the gear cover 22 so as to protrude. The first coil end portion 120*b* is locked to the inner surface of the gear cover 22. The second coil end portion 120*c* is locked to the locking protrusion 115 of the operation lever 28.

Thus, the operation lever 28 is urged in the clockwise direction by the urging force (elastic restoration force) of the second urging member 120, and hence the distal end portion of the operation lever 28 is urged in the direction of being moved toward the lock position P3. As described above, the projecting regulation piece 114 of the operation lever 28 is brought into contact with the regulation wall portion 116 of the head frame 20, and hence the operation lever 28 is restrained from being further rotated, thereby being positioned at the lock position P3. The second urging member 120 is not limited to a coil spring, and may be formed of, for example, a plate spring.

As illustrated in FIG. 4, the return mechanism 29 is a mechanism configured to move the movable blade 26 from the cutting position P1 to the standby position P2 through use of an operating (rotating) force applied to the operation lever 28 from the lock position P3 toward the unlock position P5 under a state in which the movable blade 26 is stopped at the cutting position P1 due to, for example, occurrence of paper jam before the platen lock mechanism 30 switches the lock arm to the unlock state of unlocking the platen roller 45.

As illustrated in FIG. 9 to FIG. 12, the return mechanism 29 includes a return rack 130, a return pinion 131, a return gear 132, a sun gear 133, a planetary gear 134, and an internal gear 135. The return rack 130 is formed on the drive rack 71. The return pinion 131 meshes with rack teeth 130*a* of the return rack 130. The return gear 132 and the sun gear 133 are supported so as to be rotatable about the rotation axis O1 under a state of being arranged coaxially with the rotation axis O1 of the operation lever 28. The planetary gear 134 meshes with the sun gear 133, and revolves along with movement of the operation lever 28. Further, the planetary gear 134 meshes with the internal gear 135. The sun gear 133, the planetary gear 134, and the internal gear 135 form a speed-increasing mechanism 136 (see FIG. 12).

In this embodiment, there is exemplified a case in which the return gear 132 and the sun gear 133 are formed of one member, but the present invention is not limited to this case. For example, as long as the return gear 132 and the sun gear 133 are rotatable integrally (rotatable together), the return gear 132 and the sun gear 133 may be formed of separate members and combined with each other.

The return pinion 131 is supported on the pinion support shaft 81 so as to be rotatable under a state of being arranged more on the outer side in the right-and-left direction L3 than the drive pinion 78. With this configuration, the return pinion 131 is arranged coaxially with the drive pinion 78. The return pinion 131 is capable of meshing with the return gear 132 rotated in synchronization with the operation of the operation lever 28, and is rotated by a rotation force of the return gear 132. Moreover, the return pinion 131 is capable of meshing with the rack teeth 130*a* of the return rack 130.

As illustrated in FIG. 9 and FIG. 10, the return rack 130 is formed integrally with the drive rack 71 under a state of being arranged more on the outer side in the right-and-left direction L3 than the drive rack 71 of the drive mechanism 27. The return rack 130 includes the plurality of rack teeth 130*a*. The plurality of rack teeth 130*a* are formed so as to be located not on the blade edge 26*a* side of the movable blade 26 but on the blade base side thereof. With this configuration, the return rack 130 meshes with the return pinion 131 when the movable blade 26 is at the cutting position P1, and is released from meshing with the return pinion 131 when the movable blade 26 is at the standby position P2.

In the illustrated example, the drive rack 71 and the return rack 130 are formed integrally with each other, but the present invention is not limited to this case. The return rack 130 may be formed separately from the drive rack 71. However, when the drive rack 71 and the return rack 130 are formed integrally with each other, the return rack 130 can be provided without increasing the number of parts. Accordingly, simplification of the configuration and cost reduction can be achieved, which is preferred.

Of the plurality of rack teeth 130*a*, the rack tooth 130*a* located on the blade edge 26*a* side of the movable blade 26 is referred to as a rack tooth 130*b* that is displaceable. The rack tooth 130*b* is formed at a distal end portion of a rack arm 139. A proximal end portion of the rack arm 139 is coupled to an end portion of the drive rack 71 located on the blade edge 26*a* side of the movable blade 26. Accordingly, the rack arm 139 is formed as a cantilever arm that is elastically deformable with the proximal end portion as a fulcrum in a direction of moving away from the return pinion 131. Thus, the rack arm 139 can be elastically deformed in the direction of moving away from the return pinion 131, and hence the rack tooth 130*b* can be retreated toward the radially outer side of the return pinion 131.

The reason why the rack tooth 130*b* of the return rack 130 is formed so as to be capable of retreating toward the radially outer side of the return pinion 131 is briefly described. For example, it is conceivable that, when the return rack 130 is moved in the direction indicated by the arrow "F1" of FIG. 9, the rack tooth 130*b* of the return rack 130 is brought into abutment against a tooth tip of a tooth portion of the return pinion 131. In this case, there is a fear in that movement of the return rack 130 is hindered by the tooth tip of the return pinion 131. In consideration of this, the rack tooth 130*b* is formed at the distal end portion of the rack arm 139, thereby providing a configuration in which due to elastic deformation of the rack arm 139, the rack tooth 130*b* is retreated toward the radially outer side of the return pinion 131 so as to be capable of climbing over the tooth tip of the return pinion 131. Accordingly, after the rack tooth 130*b* climbs over the tooth tip of the return pinion 131, the rack tooth 130*b* can be returned to an original position through use of an elastic restoration force of the rack arm 139, and thus the returned rack tooth 130*b* can be suitably meshed with a next tooth portion of the return pinion 131. In this manner, without causing a problem in which movement of the return rack 130 is hindered, the rack tooth 130*b* of the return rack 130 and the return pinion 131 can be suitably meshed with each other.

As illustrated in FIG. 9 and FIG. 10, the return gear 132 is supported on the lever support shaft 106 so as to be rotatable under a state of being arranged more on the outer side in the right-and-left direction L3 than the lever plate 110 of the operation lever 28. With this configuration, the return gear 132 is arranged coaxially with the rotation axis O1 of the operation lever 28.

The return gear 132 includes a gear plate 132*a* and a plurality of gear tooth portions 132*b* formed along an outer peripheral edge of the gear plate 132*a*. The plurality of gear tooth portions 132*b* are formed not along an entire periphery of the gear plate 132*a* but in a range along substantially a half of the periphery of the gear plate 132*a*. The plurality of gear tooth portions 132*b* are capable of meshing with the return pinion 131.

Of the plurality of gear tooth portions 132*b*, the gear tooth portion 132*b* that meshes with the return pinion 131 first through the operation of the operation lever 28 from the lock position P3 toward the unlock position P5 is displaceable toward a radially inner side of the return gear 132, and can be retreated from the tooth portion of the return pinion 131.

The gear tooth portion 132*b* is formed at a distal end portion of an elastic arm portion 132*c*. A proximal end portion of the elastic arm portion 132*c* is formed integrally with a portion of the outer peripheral edge of the gear plate 132*a* in which the gear tooth portions 132*b* are not formed, and the elastic arm portion 132*c* extends along the outer peripheral edge of the gear plate 132*a* in the clockwise direction in an arc shape. With this configuration, the elastic arm portion 132*c* is supported at the proximal end portion thereof on the outer peripheral edge of the gear plate 132*a* in a cantilevered manner, and is elastically deformable in a radial direction with the proximal end portion as a fulcrum. Thus, when the elastic arm portion 132*c* is elastically deformed toward the gear plate 132*a* side, the gear tooth portion 132*b* can be displaced toward the radially inner side of the return gear 132, thereby being capable of retreating from the tooth portion of the return pinion 131.

Figure 12:
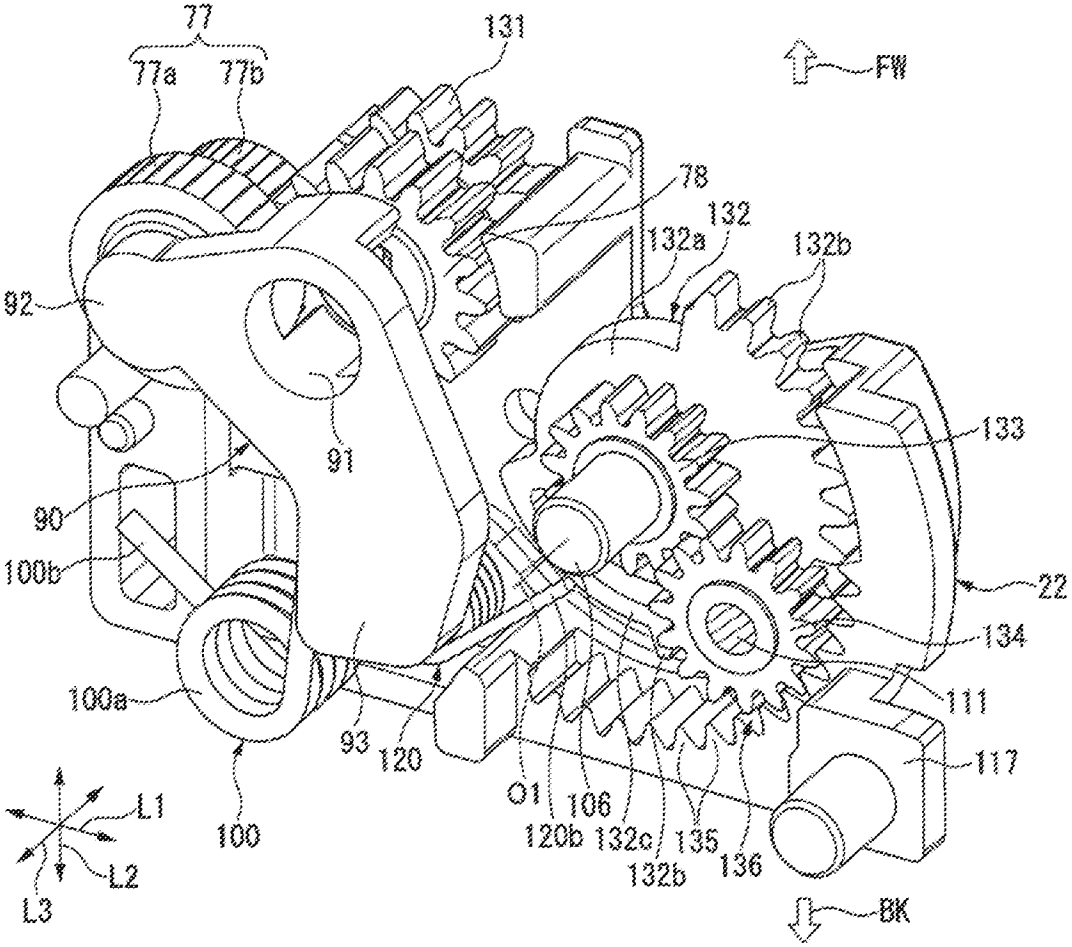
FIG. 12 is a perspective view for illustrating a state in which the operation lever is removed from the state illustrated in FIG. 11.

As illustrated in FIG. 12, the sun gear 133 is formed integrally with an inner surface of the gear plate 132*a*, and is arranged coaxially with the rotation axis O1 of the operation lever 28. With this configuration, the sun gear 133 is rotatable about the rotation axis O1 together with the return gear 132.

The planetary gear 134 is supported by the operation lever 28 through intermediation of the planetary shaft 111 so as to be rotatable under a state of meshing with the sun gear 133. With this configuration, when the operation lever 28 is rotated about the rotation axis O1, the planetary gear 134 follows movement of the operation lever 28, thereby revolving about the rotation axis O1. The internal gear 135 with which the planetary gear 134 meshes is formed on the inner surface of the gear cover 22. Therefore, the planetary gear 134 revolves along with movement of the operation lever 28, thereby being capable of rotating while meshing with the internal gear 135.

When the planetary gear 134 thus rotates, the sun gear 133 and the return gear 132 can be rotated about the rotation axis O1, and the gear tooth portions 132*b* of the return gear 132 can be meshed with the return pinion 131.

As illustrated in FIG. 5, the platen lock mechanism 30 is a mechanism including lock arms 140 and 150 that are swingable about the swing axis O2 parallel to the platen roller 45, and is configured to be switched between a lock state of locking the platen roller 45 and an unlock state of unlocking the platen roller 45.

As illustrated in FIG. 5, FIG. 9, and FIG. 10, one lock arm 140 is arranged on the one side wall portion 60 side of the head frame 20, and another lock arm 150 is arranged on the another side wall portion 61 side thereof. When the operation lever 28 is at the lock position P3, each of the pair of lock arms 140 and 150 presses the platen bearing 51 received in the receiving groove 62 from the opening 62*a* side, and is swung about the swing axis O2 from the platen unit 6 side toward the head unit 5 side along with movement of the operation lever 28 from the lock position P3 toward the unlock position P5 side. Thus, each of the pair of lock arms 140 and 150 is moved away from the platen bearing 51, thereby allowing disengagement of the platen bearing 51 from the receiving groove 62.

Therefore, through use of the pair of lock arms 140 and 150, the platen lock mechanism 30 in this embodiment can lock the pair of platen bearings 51 at the same time, and can unlock the pair of platen bearings 51 at the same time.

The one lock arm 140 and the another lock arm 150 are coupled to each other through intermediation of a coupling shaft portion 141 having a large length and extending in the right-and-left direction L3. As illustrated in FIG. 10, the coupling shaft portion 141 is a columnar shaft. The coupling shaft portion 141 is formed so as to pass through the head frame 20 in the right-and-left direction L3, and is supported on the one side wall portion 60 and the another side wall portion 61 so as to be rotatable. A center axis of the coupling shaft portion 141 matches with the swing axis O2.

Further, the one lock arm 140 and the another lock arm 150 are coupled to both end portions of the coupling shaft portion 141, respectively. With this configuration, the one lock arm 140 and the another lock arm 150 are swingable about the swing axis O2 in a synchronized manner with the coupling shaft portion 141 interposed therebetween.

The coupling shaft portion 141 is arranged so as to be located between the receiving grooves 62 and the return gear 132 in the up-and-down direction L1, and located more on the back side BK in the front-and-back direction L2 than the receiving grooves 62.

In this embodiment, there is exemplified a case in which the pair of lock arms 140 and 150 arranged in the right-and-left direction L3 is coupled to each other through intermediation of the coupling shaft portion 141 so as to be swingable, but the present invention is not limited to this case. For example, the pair of lock arms 140 and 150 and the coupling shaft portion 141 may be formed of one member by being integrally formed through bending of, for example, a single metal plate.

Figure 13:
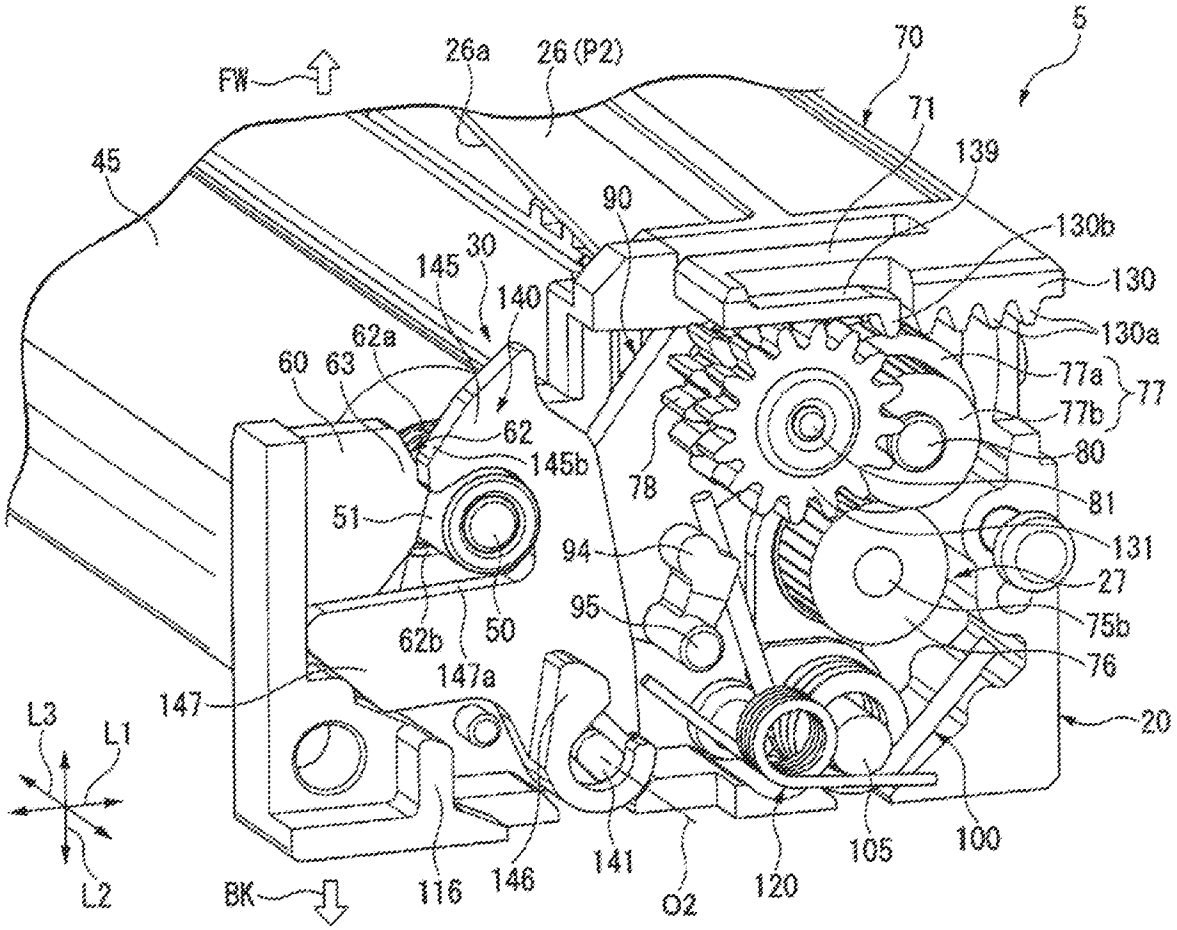
FIG. 13 is a perspective view for illustrating a state in which the operation lever is removed from the state illustrated in FIG. 10.

The one lock arm 140 is described in detail. As illustrated in FIG. 13, the lock arm 140 is arranged more on the upper side than the receiving groove 62, and is formed so as to extend in the front-and-back direction L2. A proximal end portion of the lock arm 140 is coupled to the end portion of the coupling shaft portion 141. A lock claw portion 145 is formed at a distal end portion of the lock arm 140, and is configured to cover the platen bearing 51 received in the receiving groove 62 from the opening 62*a* side of the receiving groove 62. With this configuration, the lock claw portion 145 and the groove bottom portion 62*b* of the receiving groove 62 can hold the platen bearing 51 so as to sandwich the platen bearing 51 therebetween.

An outer surface of the lock claw portion 145 is formed as an inclined guide surface 145*b* configured to guide the platen bearing 51 into the receiving groove 62 when the platen bearing 51 is set in the receiving groove 62. The guide surface 145*b* is formed so as to define a V-shaped groove together with the guide protrusion 63 on the receiving groove 62 side in side view.

Moreover, an engagement wall portion 146 is formed at the proximal end portion of the lock arm 140 so as to protrude toward the outer side in the right-and-left direction L3. The engagement wall portion 146 is a wall portion with which the lever projecting portion 112 of the operation lever 28 is brought into contact after the pushing-up cam 113 swings the swing plate 90 through the engagement pin 95 when the operation lever 28 is operated from the lock position P3 toward the unlock position P5.

Thus, the entire lock arm 140 is pushed by the lever projecting portion 112 through the engagement wall portion 146 along with the operation of the operation lever 28, thereby being swung about the swing axis O2 in the clockwise direction. That is, the lock arm 140 is configured so as to be swung upward about the swing axis O2 from the platen unit 6 side toward the head unit 5 side. Accordingly, the lock claw portion 145 of the lock arm 140 is gradually moved away from the platen bearing 51 along with the operation of the operation lever 28. When the operation lever 28 reaches the unlock position P5, the lock claw portion 145 is retreated from the receiving groove 62 toward the head unit 5 side, thereby opening the opening 62*a*. In this manner, the lock arm 140 allows disengagement of the platen bearing 51 from the receiving groove 62.

Moreover, the lock arm 140 includes a pushing-up arm 147 configured to push the platen bearing 51 from the groove bottom portion 62*b* of the receiving groove 62 toward the opening 62*a* side along with movement of the operation lever 28 from the lock position P3 toward the unlock position P5. The pushing-up arm 147 is arranged more on the back side BK than the groove bottom portion 62*b*, and is formed so as to extend downward from each of the lock arms 140 and 150. A surface of the pushing-up arm 147 facing the platen bearing 51 is formed so as to extend in parallel to the groove bottom portion 62*b*, and serves as a pushing surface 147*a* configured to push the platen bearing 51.

When the operation lever 28 is at the lock position P3, a gap is secured between the pushing surface 147*a* and the platen bearing 51. Accordingly, when the operation lever 28 is at the lock position P3, the pushing-up arm 147 waits in non-contact with the platen bearing 51.

In particular, the pushing-up arm 147 is formed so as to extend downward with a large length, and hence can significantly push the platen bearing 51 toward the opening 62*a* when pushing the platen bearing 51 in the receiving groove 62. Specifically, the pushing-up arm 147 can push the platen bearing 51 so as to move a roller center of the platen roller 45 more toward the opening 62*a* side than the apex portion 63*a* of the guide protrusion 63 formed on the receiving groove 62.

The lock arm 140 configured as described above is urged in the counterclockwise direction toward the platen unit 6 side by receiving an urging force of urging the another lock arm 150 (see FIG. 5) arranged on the another side wall portion 61 side of the head frame 20. Thus, the lock arm 140 is always urged so as to assume such a posture that the lock claw portion 145 covers the platen bearing 51 from the opening 62*a* side.

Figure 14:
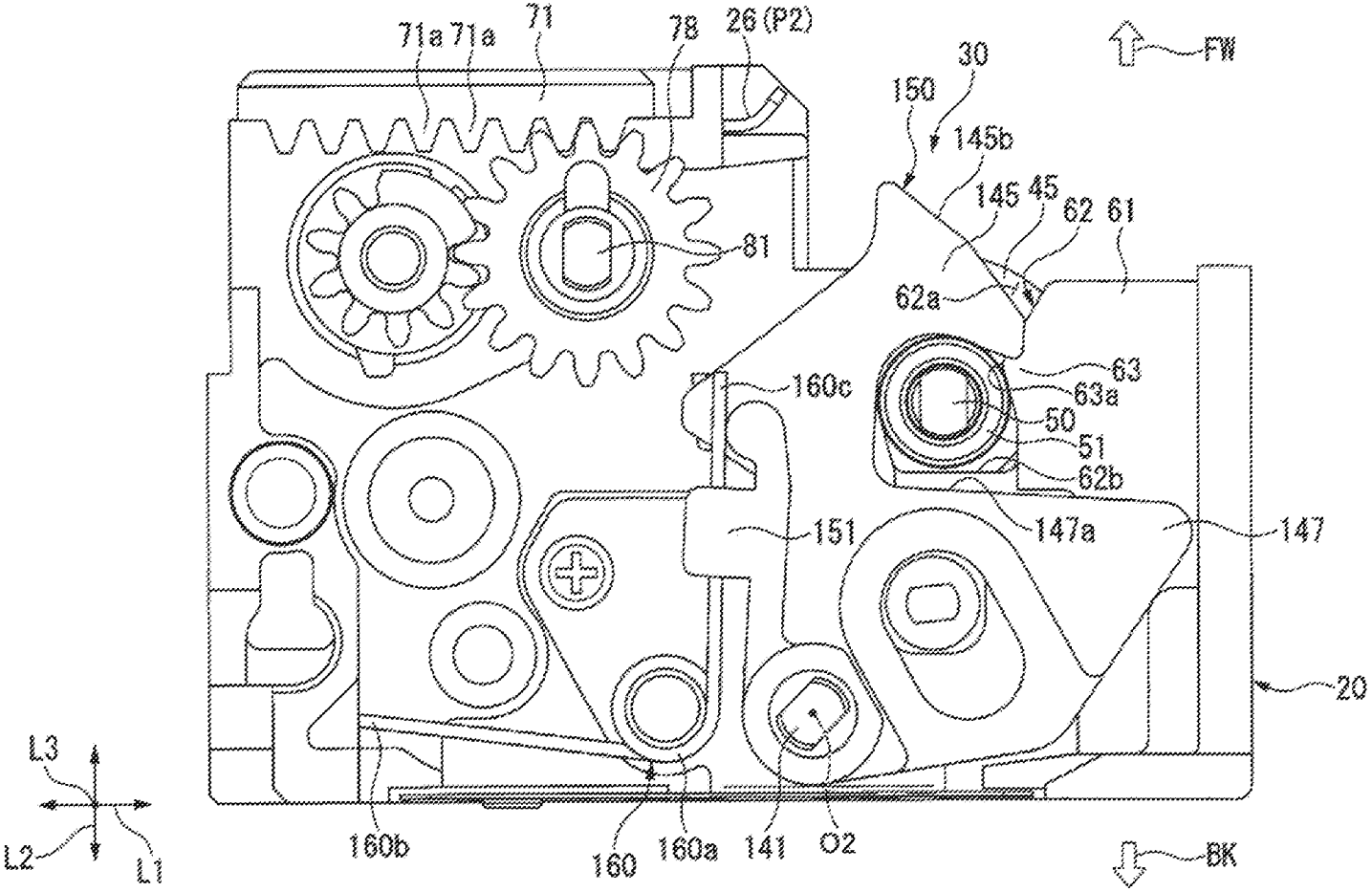
FIG. 14 is a side view for illustrating a periphery of another lock arm.

Next, with reference to FIG. 14, the another lock arm 150 is described. However, the another lock arm 150 basically has the same configuration as that of the one lock arm 140. Accordingly, the same components are denoted by the same reference symbols, and description thereof is omitted.

As illustrated in FIG. 14, the another lock arm 150 includes a locking protrusion 151 formed so as to protrude toward the outer side in the right-and-left direction L3. By an urging force of a third urging member (urging member according to the present invention) 160, the lock arm 150 is always urged so as to assume such a posture that the lock claw portion 145 covers the platen bearing 51 from the opening 62*a* side.

The third urging member 160 is, for example, a coil spring, and includes a coil portion 160*a*, a first coil end portion 160*b*, and a second coil end portion 160*c*. The coil portion 160*a* is supported on a coil support shaft (not shown) formed on an inner surface of another gear cover 23 so as to protrude. The first coil end portion 160*b* is locked to the head frame 20. The second coil end portion 160*c* is locked to the locking protrusion 151 of the lock arm 150.

With this configuration, in the state illustrated in FIG. 14, the lock arm 150 is urged in the clockwise direction by the urging force (elastic restoration force) of the third urging member 160. Thus, in the state illustrated in FIG. 13, the one lock arm 140 is urged in the counterclockwise direction. The third urging member 160 is not limited to a coil spring, and may be formed of, for example, a plate spring.

As illustrated in FIG. 5, when the platen unit 6 in this embodiment is combined with the head unit 5, the driven gear 52 is arranged more on the outer side in the right-and-left direction L3 than the another lock arm 150. The driven gear 52 is capable of meshing with a platen gear train mechanism (not shown) arranged on the another side wall portion 61 side of the head frame 20. The platen gear train mechanism is operated by receiving power from a driving motor (not shown) configured to drive the platen roller 45, thereby playing a role of transmitting the power to the driven gear 52. Thus, when the head unit 5 and the platen unit 6 are combined with each other, the platen roller 45 is rotated, thereby being capable of feeding the recording sheet P.

Next, description is made of actions of the thermal printer 1 configured as described above. First, description is made of a case in which the head unit 5 and the platen unit 6 are combined with each other. In this case, as illustrated in FIG. 2, after the recording sheet P having a roll shape is loaded into and set in the recording sheet receiving portion 16 of the casing 2, through a closing operation of the printer cover 3, the platen unit 6 can be brought close to the head unit 5. Then, as illustrated in FIG. 1, when the printer cover 3 is completely closed, the head unit 5 and the platen unit 6 can be combined with each other under a state in which the recording sheet P is sandwiched between the thermal head 25 and the platen roller 45.

Along with the closing operation of the printer cover 3, the platen bearings 51 of the platen roller 45 are guided by the guide protrusions 63 of the receiving grooves 62 and the guide surfaces 145*b* of the lock claw portions 145 so as to be fitted into the receiving grooves 62, and then are received in the receiving grooves 62. At this time, the platen bearings 51 are fitted into the receiving grooves 62 while slightly pushing aside the lock claw portions 145 against the urging force of the third urging member 160.

After being pushed by the platen bearing 51, each of the lock arms 140 and 150 is swung about the swing axis O2 by the urging force of the third urging member 160 to be returned to the original position, and then presses the platen bearing 51 from the opening 62*a* side of the receiving groove 62 through use of the lock claw portion 145. Thus, as illustrated in FIG. 5, through use of the pair of lock arms 140 and 150, the pair of platen bearings 51 respectively received in the pair of receiving grooves 62 can be pressed, thereby being capable of preventing the platen bearings 51 from slipping out of the receiving grooves 62. Therefore, through use of the platen lock mechanism 30, the platen roller 45 can be maintained in the lock state.

In this manner, combination between the head unit 5 and the platen unit 6 can be locked. At the same time, the printer cover 3 can be locked to the casing 2. When the head unit 5 and the platen unit 6 are combined with each other, the thermal head 25 and the platen roller 45 are held in press-contact with each other by predetermined pressure under a state of sandwiching the recording sheet P therebetween. Further, after passing through between the movable blade 26 and the fixed blade 46, the recording sheet P is drawn out of the casing 2 through the delivery port 18. Moreover, the driven gear 52 of the platen roller 45 meshes with the platen gear train mechanism on the head unit 5 side.

Next, a case of performing printing of various kinds of information on the recording sheet P is briefly described. In this case, through drive of the driving motor, the driven gear 52 is rotated through the platen gear train mechanism. Thus, the platen roller 45 can be rotated, and the recording sheet P sandwiched between the thermal head 25 and the platen roller 45 can be fed toward the delivery port 18. Further, simultaneously with this, a control signal associated with printing data is output, thereby causing the heating elements of the thermal head 25 to generate heat as appropriate. In this manner, for example, various characters and figures can be clearly printed on the recording sheet P to be fed. A printed part of the recording sheet P is caused to pass through between the fixed blade 46 and the movable blade 26.

Next, a case of cutting the recording sheet P is briefly described. In this case, through drive of the driving motor 75, the drive intermediate wheel 76 illustrated in FIG. 9 is rotated. Thus, the drive pinion 78 can be rotated through the double intermediate wheel 77 (including the large-diameter intermediate wheel 77*a* and the small-diameter intermediate wheel 77*b*), and the drive rack 71 can be moved together with the return rack 130 in the direction indicated by the arrow "F1". Accordingly, the movable blade 26 can be moved from the standby position P2 to the cutting position P1, thereby being capable of cutting the recording sheet P while sandwiching the recording sheet P together with the fixed blade 46 as illustrated in FIG. 8. As a result, a cut piece of the recording sheet P can be used as, for example, a receipt or a ticket.

After cutting of the recording sheet P, the driving motor 75 is rotated reversely. Thus, the drive pinion 78 can be rotated reversely through the drive intermediate wheel 76 and the double intermediate wheel 77, and as illustrated in FIG. 9, the drive rack 71 can be moved together with the return rack 130 in the direction indicated by the arrow "F2". Accordingly, the movable blade 26 can be moved and returned from the cutting position P1 to the standby position P2.

Further, at the time of cutting of the recording sheet P, meshing between the return pinion 131 and the gear tooth portions 132*b* of the return gear 132 is released, and hence the return pinion 131 is allowed to idly rotate. Accordingly, when the movable blade 26 is moved to the cutting position P1, even when the rack teeth 130*a* and the rack tooth 130*b* of the return rack 130 mesh with the return pinion 131, the return pinion 131 can be idly rotated. Therefore, without being influenced by the return pinion 131, the drive rack 71 and the return rack 130 can be moved, and cutting of the recording sheet P can be performed.

Next, description is made of a series of actions in a case of unlocking the platen unit 6 so as to open the printer cover 3 while removing paper jam through the operation of the operation lever 28 when paper jam occurs between the movable blade 26 and the fixed blade 46. When paper jam occurs during cutting of the recording sheet P, as illustrated in FIG. 15, the movable blade 26 is stopped at the cutting position P1 at which the movable blade 26 climbs over the fixed blade 46.

Figure 15:
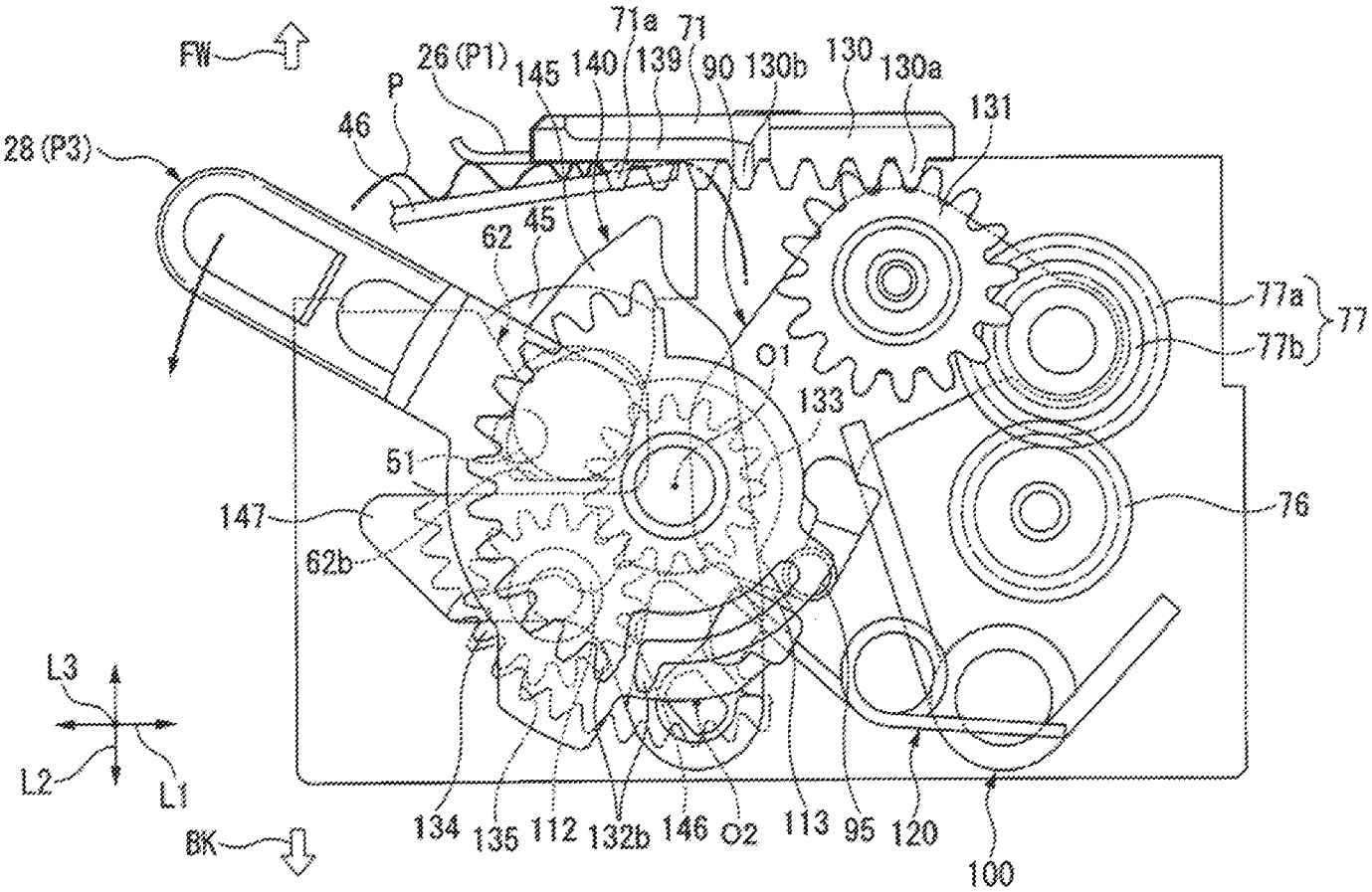
FIG. 15 is a side view for illustrating a state in which paper jam occurs between the movable blade and the fixed blade from the state illustrated in FIG. 9.

In this case, as illustrated in FIG. 15, against the urging force of the second urging member 120, the operation lever 28 is operated from the lock position P3 toward the unlock position P5 side. Thus, the operation lever 28 can be moved so as to rotate about the rotation axis O1 in the counterclockwise direction. Further, along with movement of the operation lever 28, the planetary gear 134 meshing with the internal gear 135 can be revolved about the rotation axis O1 in the counterclockwise direction while being rotated about the planetary shaft 111 in the clockwise direction. Still further, along with rotation of the planetary gear 134, the sun gear 133 and the return gear 132 can be rotated about the rotation axis O1 in the counterclockwise direction.

Figure 16:
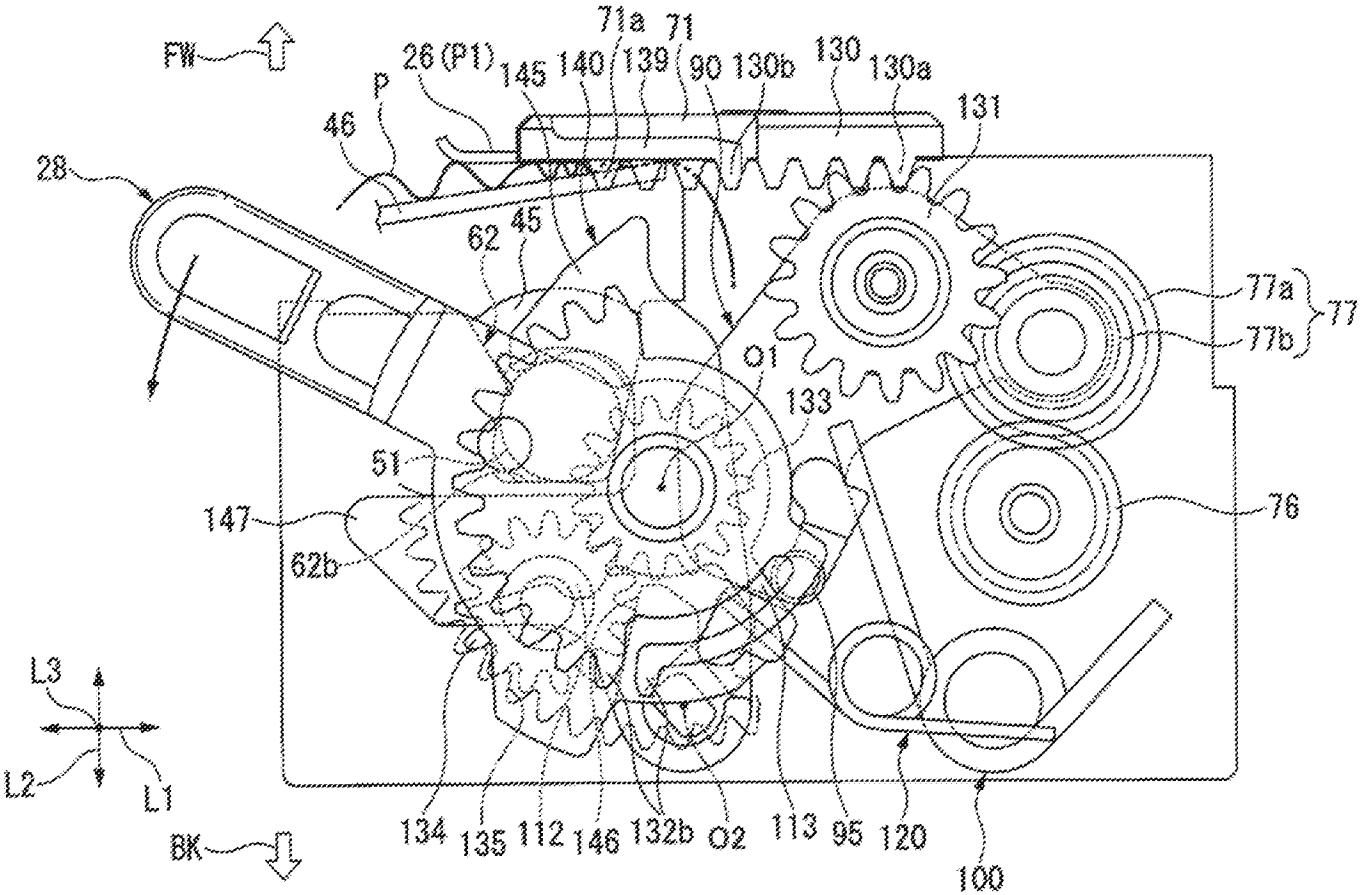
FIG. 16 is a side view for illustrating a state in which the operation lever is operated to be pushed from a lock position illustrated in FIG. 15.

When the operation lever 28 is rotated in the counterclockwise direction, as illustrated in FIG. 16, the pushing-up cam 113 is brought into contact with the engagement pin 95, and thus applies an external force to the swing plate 90 through the engagement pin 95. Accordingly, through further operation of the operation lever 28, as illustrated in FIG. 17, the swing plate 90 can be pushed up by the pushing-up cam 113, and the swing plate 90 can be swung about the pinion support shaft 81 in the counterclockwise direction against the urging force of the first urging member 100.

Thus, the double intermediate wheel 77 mounted to the swing plate 90 can be moved away from the drive intermediate wheel 76, and meshing between the double intermediate wheel 77 and the drive intermediate wheel 76 can be released. Therefore, the position of the operation lever 28 at this time corresponds to the meshing release position P4.

Further, simultaneously with swing of the swing plate 90, the sun gear 133 and the return gear 132 are rotated in the counterclockwise direction along with the operation of the operation lever 28. Accordingly, as illustrated in FIG. 17, at a timing at which meshing between the double intermediate wheel 77 and the drive intermediate wheel 76 is released, the first gear tooth portion 132*b* of the return gear 132 can be meshed with the return pinion 131. Thus, the return pinion 131 can be rotated in the clockwise direction.

Figure 17:
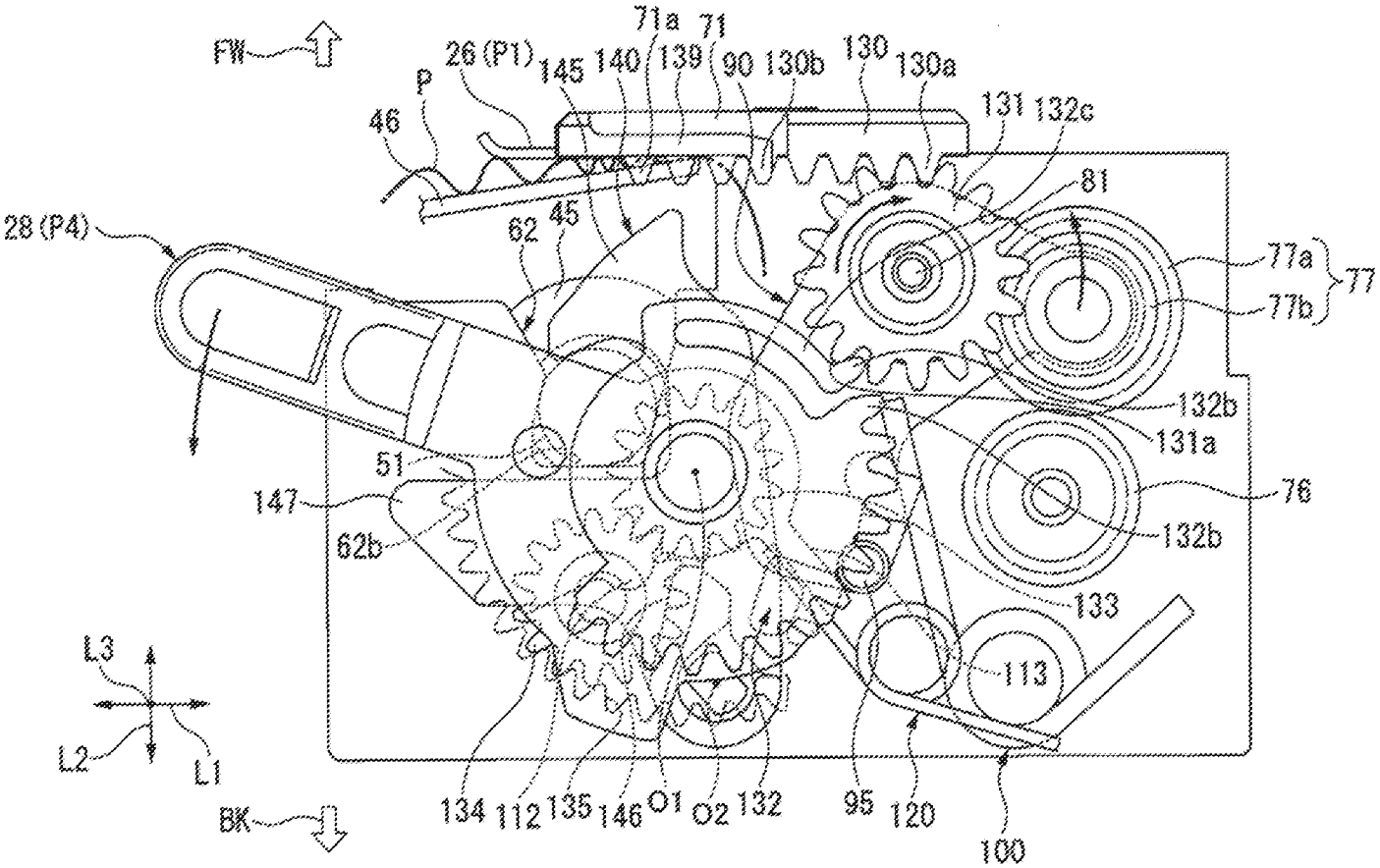
FIG. 17 is a side view for illustrating a state in which the operation lever is operated to be further pushed from the state illustrated in FIG. 16.
Figure 18:
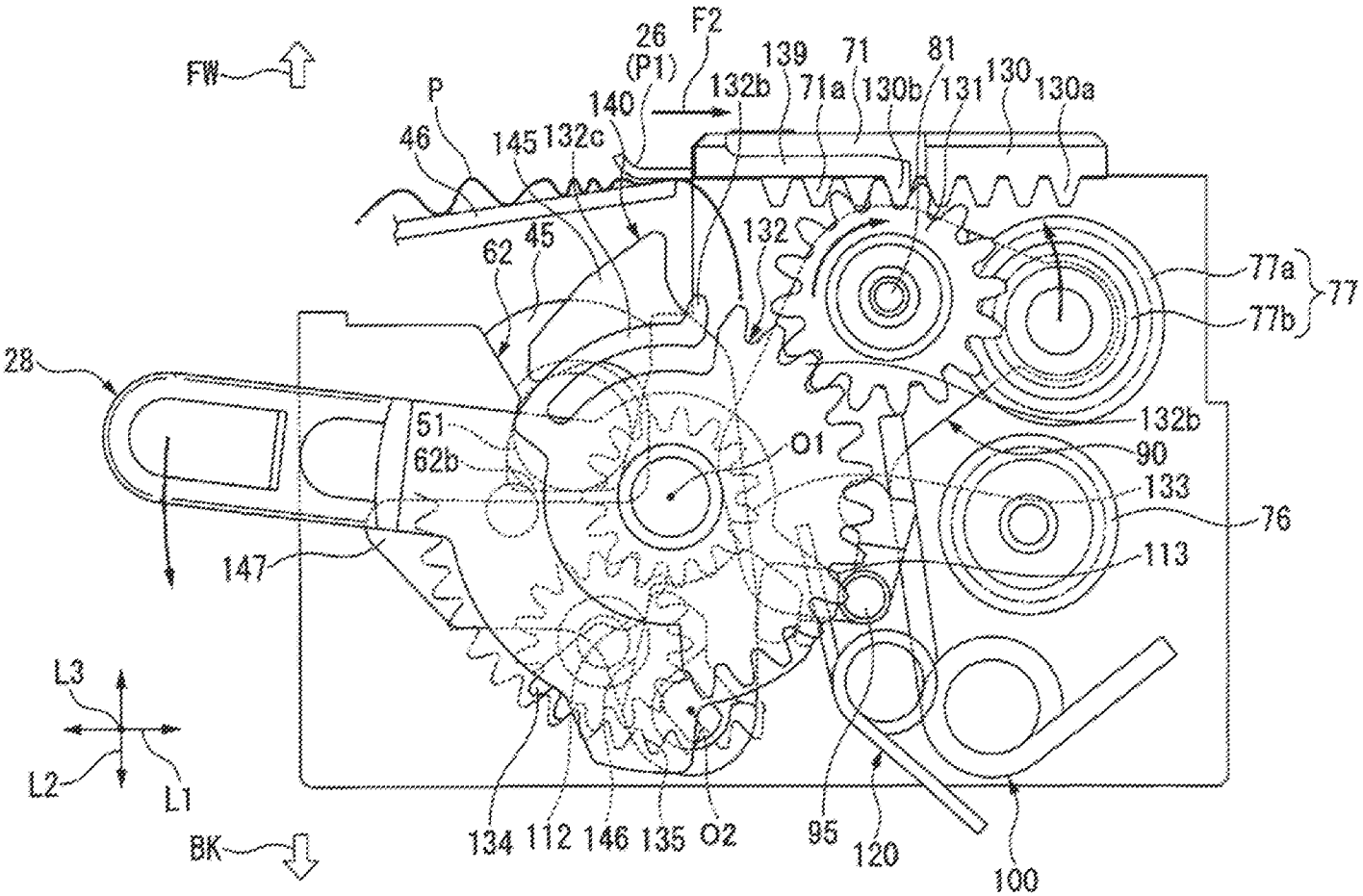
FIG. 18 is a side view for illustrating a state in which the operation lever is operated to be further pushed from the state illustrated in FIG. 17, thereby being positioned at a meshing release position.
Figure 19:
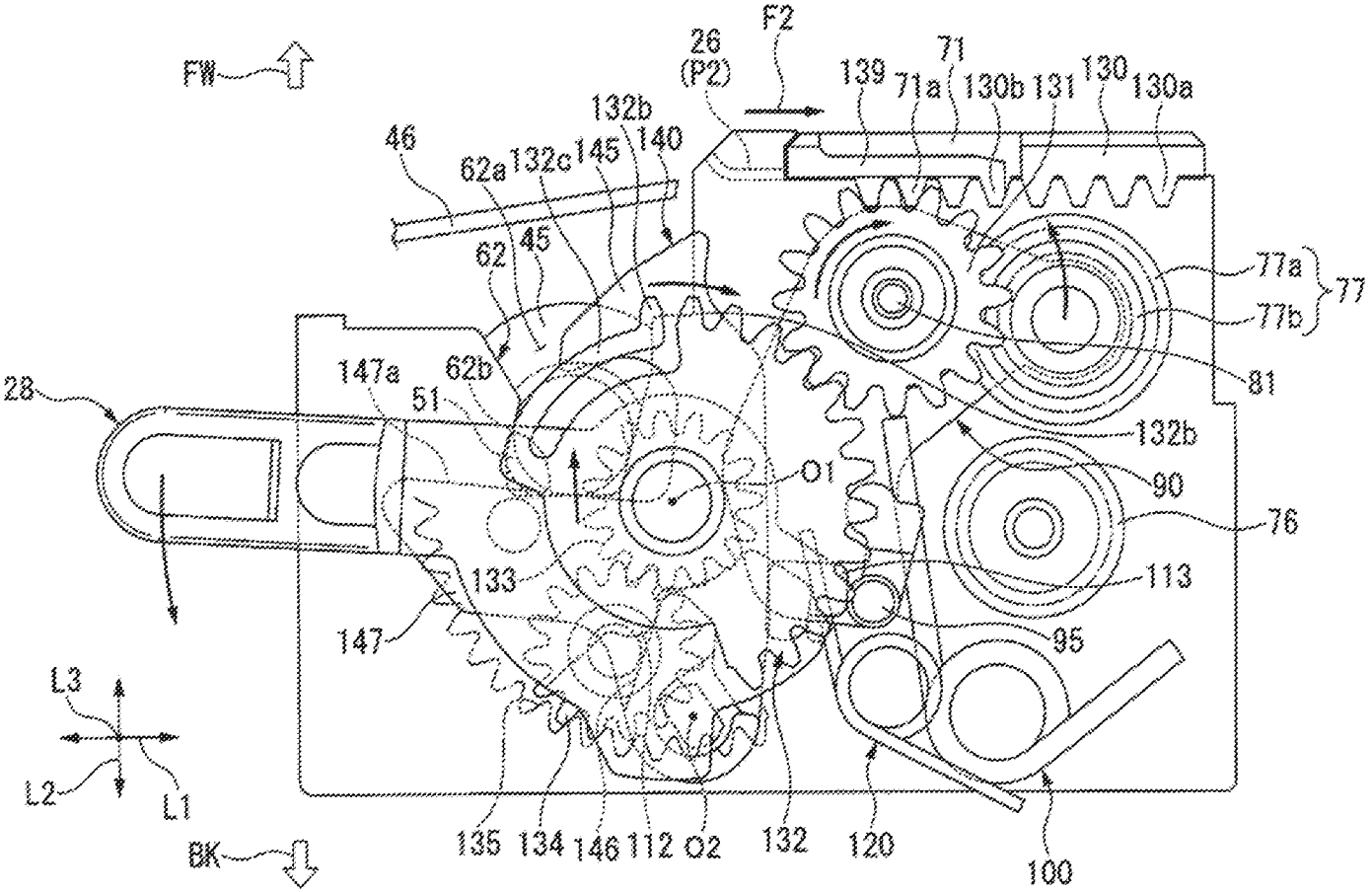
FIG. 19 is a side view for illustrating a state in which the operation lever is operated to be further pushed from the state illustrated in FIG. 18, thereby returning the movable blade to a standby position.

Therefore, when the operation lever 28 is further operated from the meshing release position P4 illustrated in FIG. 17 toward the unlock position P5 side, as illustrated in FIG. 18 and FIG. 19, the other gear tooth portions 132*b* of the return gear 132 can be successively meshed with the return pinion 131, thereby being capable of continuously rotating the return pinion 131 in the clockwise direction. Accordingly, the return rack 130 meshing with the return pinion 131 can be moved in the direction indicated by the arrow "F2", and the movable blade 26 can be forcibly returned from the cutting position P1 to the standby position P2. Thus, a state of the movable blade 26 overlapping the fixed blade 46 can be cancelled, and paper jam can be removed.

When the movable blade 26 is returned to the standby position P2 through use of the return pinion 131, the drive rack 71 is also moved together with the return rack 130, and hence the drive pinion 78 is rotated. At this time, as described above, meshing between the double intermediate wheel 77 and the drive intermediate wheel 76 is released, and hence the drive pinion 78 and the double intermediate wheel 77, which meshes with the drive pinion 78, can be caused to idly rotate. Accordingly, without being influenced by the drive pinion 78 and the double intermediate wheel 77, the movable blade 26 can be returned to the standby position P2.

When the movable blade 26 is returned to the standby position P2, as illustrated in FIG. 19, the rack teeth 130*a* and the rack tooth 130*b* of the return rack 130 are disengaged from the return pinion 131. Therefore, at a stage at which the movable blade 26 is returned to the standby position P2 and paper jam is removed, meshing between the rack teeth 130*a* and the rack tooth 130*b* of the return rack 130, and the return pinion 131 can be released.

Further, as illustrated in FIG. 19, at a timing at which the movable blade 26 is returned to the standby position P2, the lever projecting portion 112 of the operation lever 28 is brought into contact with the engagement wall portion 146 of the one lock arm 140, and thus applies an external force to the lock arm 140 through the engagement wall portion 146. Thus, the lock arm 140 can be pushed up, and the lock arm 140 can be swung about the swing axis O2 from the platen unit 6 side toward the head unit 5 side against the urging force of the third urging member 160. Accordingly, along with swing of the lock arm 140, the lock claw portion 145 can be gradually moved away from the platen bearing 51.

Figure 20:
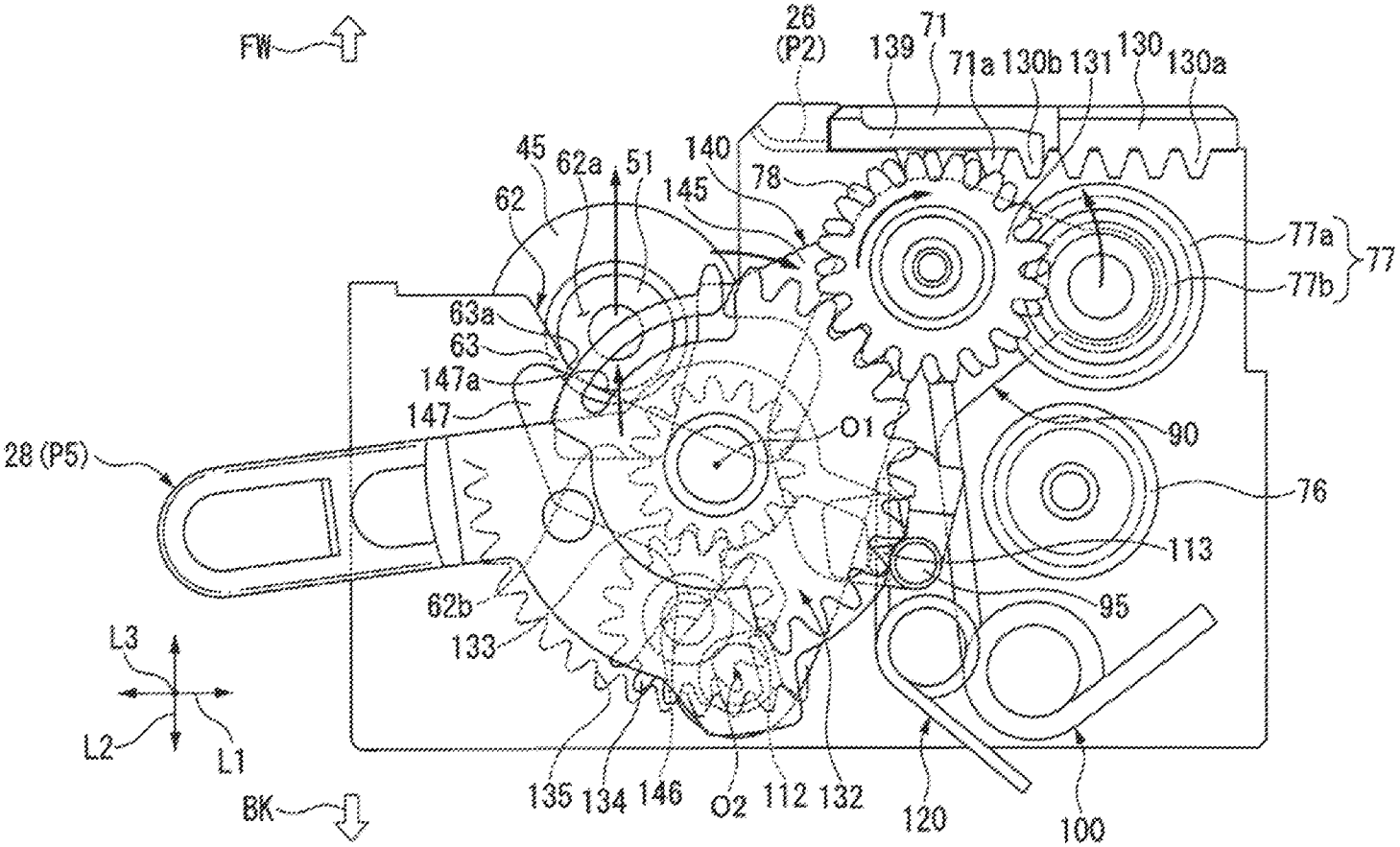
FIG. 20 is a side view for illustrating a state in which the operation lever is operated to be further pushed from the state illustrated in FIG. 19, and thus is positioned at an unlock position, thereby pushing the platen bearing to an opening of the receiving groove.

Then, when the operation lever 28 is further operated to move to the unlock position P5 as illustrated in FIG. 20, the lock arm 140 can be retreated from the receiving groove 62 toward the head unit 5 side, and the lock claw portion 145 is significantly moved away from the platen bearing 51, thereby being capable of opening the opening 62*a*. Thus, disengagement of the platen bearing 51 from the receiving grooves 62 is allowed.

Further, in synchronization with the above-mention movement of the lock arm 140, as illustrated in FIG. 20, through use of the pushing-up arm 147, the platen bearing 51 can be pushed up from the groove bottom portion 62*b* of the receiving groove 62 toward the opening 62*a* side. In particular, when the operation lever 28 reaches the unlock position P5, as illustrated in FIG. 20, through use of the pushing-up arm 147, the platen bearing 51 can be pushed up so that the roller center of the platen roller 45 is moved more toward the opening 62*a* side than the apex portion 63*a* of the guide protrusion 63.

Another lock arm 150 is operated in synchronization with the one lock arm 140 through the coupling shaft portion 141, and hence can be operated in the same manner as the above-mentioned manner. Therefore, when the operation lever 28 is brought to the unlock position P5, the platen roller 45 can be switched to the unlock state through use of the platen lock mechanism 30, thereby being capable of detaching the head unit 5 and the platen unit 6 from each other. As a result, the printer cover 3 to which the platen unit 6 is mounted can be opened.

As described above, according to the printing unit 4 and the thermal printer 1 in this embodiment, through use of the lock arms 140 and 150, disengagement of the platen bearings 51 from the receiving grooves 62 can be prevented, and hence the platen roller 45 can be reliably locked. In addition, the lock arms 140 and 150 are urged by the third urging member 160 so as to maintain the lock state. Thus, the lock arms 140 and 150 can be prevented from being swung about the swing axis O2 unintentionally and releasing the lock state.

Moreover, in synchronization with the operation of the operation lever 28, not only the lock arms 140 and 150 can be retreated from the receiving grooves 62, but also the platen bearings 51 can be forcibly pushed up toward the openings 62*a* side through use of the pushing-up arms 147. Accordingly, without being influenced by the urging force of the third urging member 160, the platen roller 45 can be disengaged from the receiving grooves 62. Therefore, it is not required that the operation lever 28 be operated with an excessive force. Thus, the platen roller 45 can be unlocked by a slight operating force, and the head unit 5 and the platen unit 6 can be smoothly detached from each other.

In addition, at the time of unlocking the platen roller 45, unlike the related art, the lock arms 140 and 150 are swung from the platen unit 6 side toward the head unit 5 side, and hence it is not required that a motion space configured to allow motion of the lock arms 140 and 150 be secured on the platen unit 6 side. Therefore, owing to omission of the space, the platen unit 6 can be downsized and thinned, and a contour size of the entire printing unit 4 can be reduced.

Moreover, the platen bearings 51 are pressed through use of the lock arms 140 and 150, and hence such a trouble called one-sided fastening (uneven heights) is less liable to occur that one of the platen bearings 51 is locked, but another one of the platen bearings 51 is not locked or locked unsatisfactorily. Accordingly, it is not required to add, for example, a mechanism configured to prevent the one-sided fastening, and hence ease of design can be achieved. Moreover, each of the lock arms 140 and 150 and the pushing-up arm 147 are integrally formed as one member, and hence the number of parts can be reduced, thereby being capable of achieving simplification of the configuration.

Further, when each platen bearing 51 is pushed up through use of the pushing-up arm 147, the pushing-up arm 147 pushes the platen bearing 51 significantly and forcibly so as to move the roller center of the platen roller 45 more toward the opening 62*a* side than the apex portion 63*a* of the guide protrusion 63. Accordingly, the pushing-up arm 147 can push up the platen bearing 51 to a position near the opening 62*a* of the receiving groove 62, thereby being capable of shifting the platen bearing 51 to an almost disengaged state. Thus, work of detaching the head unit 5 and the platen unit 6 from each other can be performed more easily.

Moreover, the return mechanism 29 is provided. With this configuration, even when paper jam occurs between the fixed blade 46 and the movable blade 26 and thus the movable blade 26 is stopped at the cutting position P1 due to the paper jam, after the paper jam is removed through the operation of the operation lever 28, the platen roller 45 can be unlocked. Therefore, the printing unit 4 and the thermal printer 1 excellent in user-friendliness can be provided. In particular, along with the operation of the operation lever 28 from the lock position P3 toward the unlock position P5, removal of paper jam and unlocking of the platen roller 45 can be performed in synchronism in a series of flows, thereby being capable of providing the printing unit 4 and the thermal printer 1 that are more user-friendly.

In addition, the speed-increasing mechanism 136 employing the planetary gear 134 is provided. With this configuration, a large rotation amount of the return gear 132 can be secured with respect to an operation stroke amount of the operation lever 28. Therefore, while the operation stroke amount of the operation lever 28 is reduced to a smaller amount, a rotation amount of the return gear 132 required for returning the movable blade 26 to the standby position P2 side can be secured. Thus, operability of the operation lever 28 can be satisfactorily secured.

Further, according to the return gear 132 in this embodiment, the gear tooth portion 132*b* that meshes with the return pinion 131 first can be retreated toward the radially inner side of the return gear 132. Thus, the gear tooth portions 132*b* can be more reliably meshed with the return pinion 131.

This point is briefly described. For example, as illustrated in FIG. 17, it is probable that, when the gear tooth portion 132*b* of the return gear 132 meshes with the return pinion 131, a tooth tip 131*a* of a pinion tooth of the return pinion 131 is brought into abutment against the tooth tip of the gear tooth portion 132*b*, and thus rotation of the return gear 132 is hindered by the return pinion 131. However, even in this case, due to elastic deformation of the elastic arm portion 132*c*, the gear tooth portion 132*b* can be retreated toward the radially inner side of the return gear 132. Thus, along with rotation of the return gear 132, the gear tooth portion 132*b* can be moved so as to climb over the tooth tip 131*a* of the pinion tooth. Accordingly, after climbing over the tooth tip 131*a* of the pinion tooth, the gear tooth portion 132*b* can be returned from a retreated position to an original position through use of the elastic restoration force of the elastic arm portion 132*c*. Accordingly, the gear tooth portion 132*b* can be meshed with the next pinion tooth.

Next, another embodiment of the present invention is described referring to the drawings. In this embodiment, the same components as those of the above-mentioned embodiment are denoted by the same reference symbols, and description thereof is omitted herein. Therefore, points different from those of the above-mentioned embodiment are mainly described.

Figure 21:
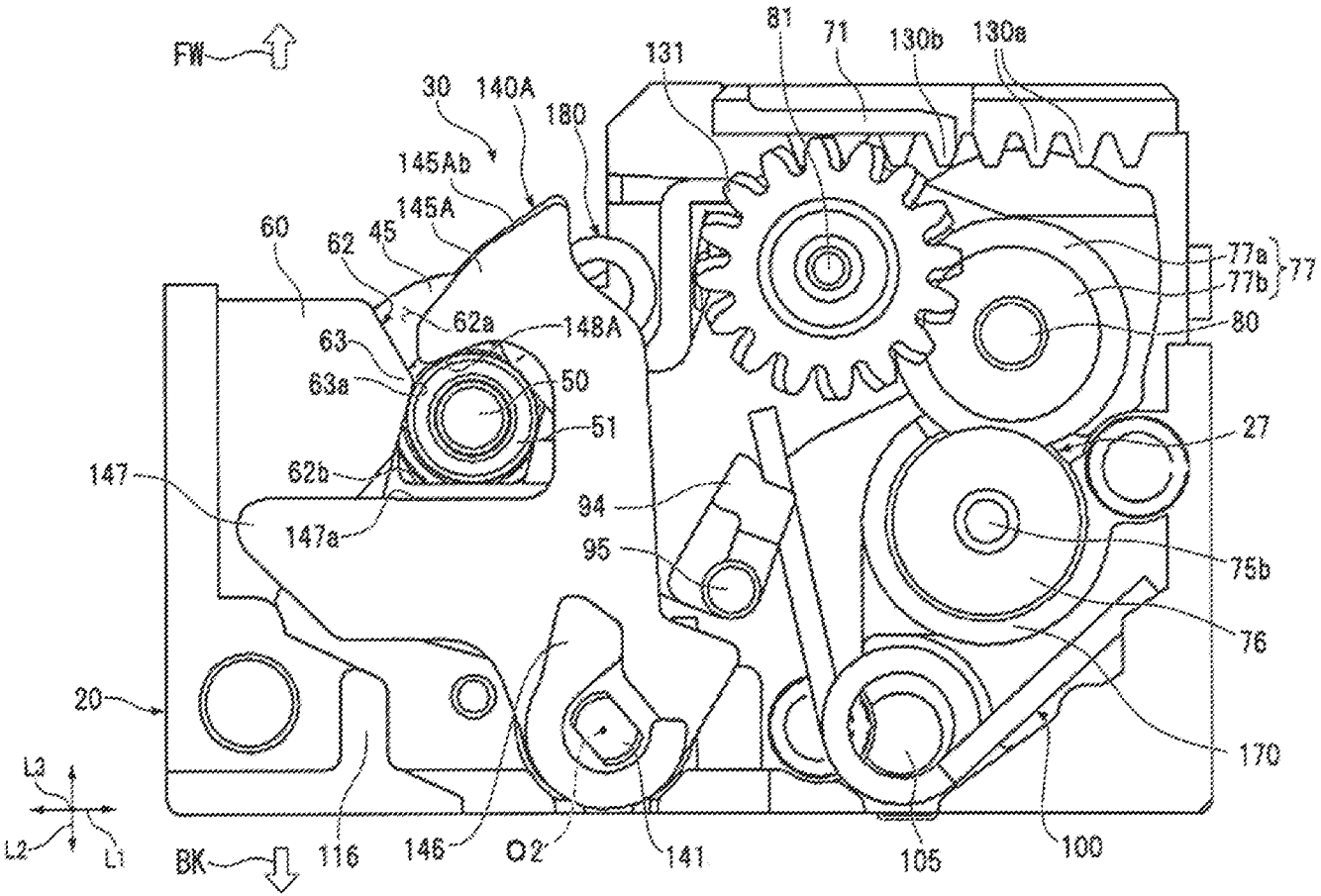
FIG. 21 is a side view for illustrating a thermal printer according to another embodiment of the present invention when seen from the direction indicated by the arrow "A" of FIG. 5.
Figure 22:
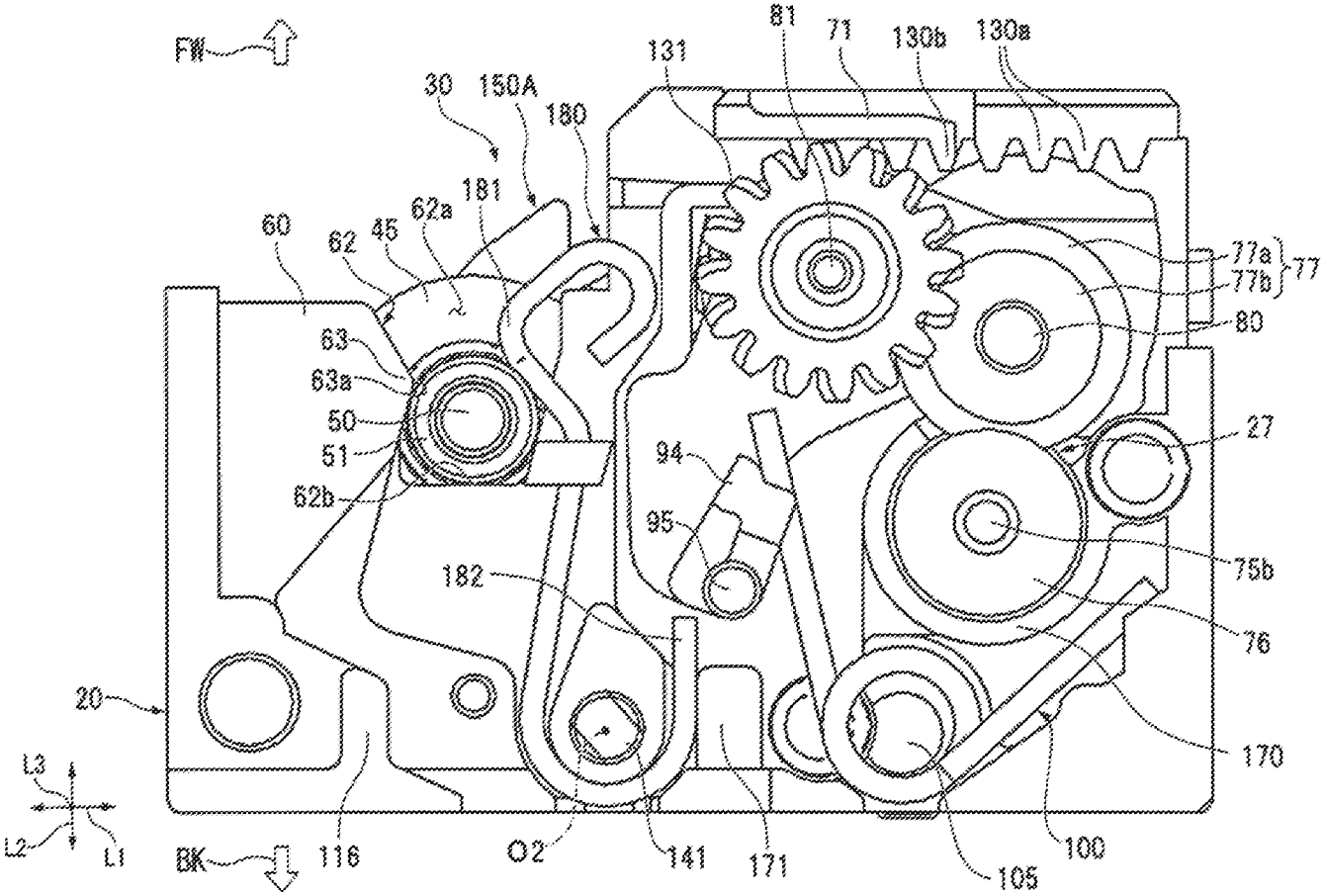
FIG. 22 is a side view for illustrating a state in which a lock arm is removed from the state illustrated in FIG. 21.
Figure 23:
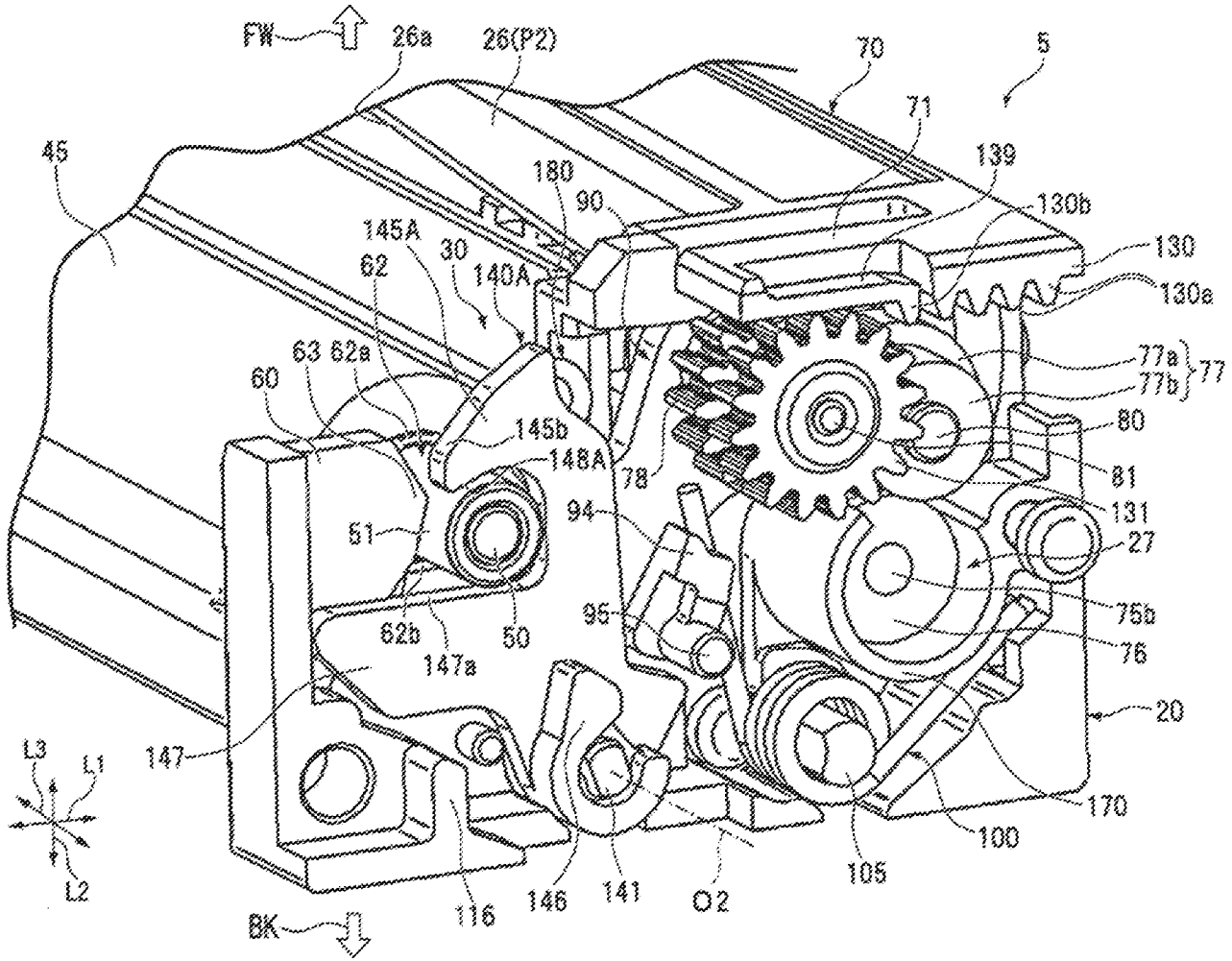
FIG. 23 is a perspective view for illustrating mechanisms of FIG. 21.
Figure 24:
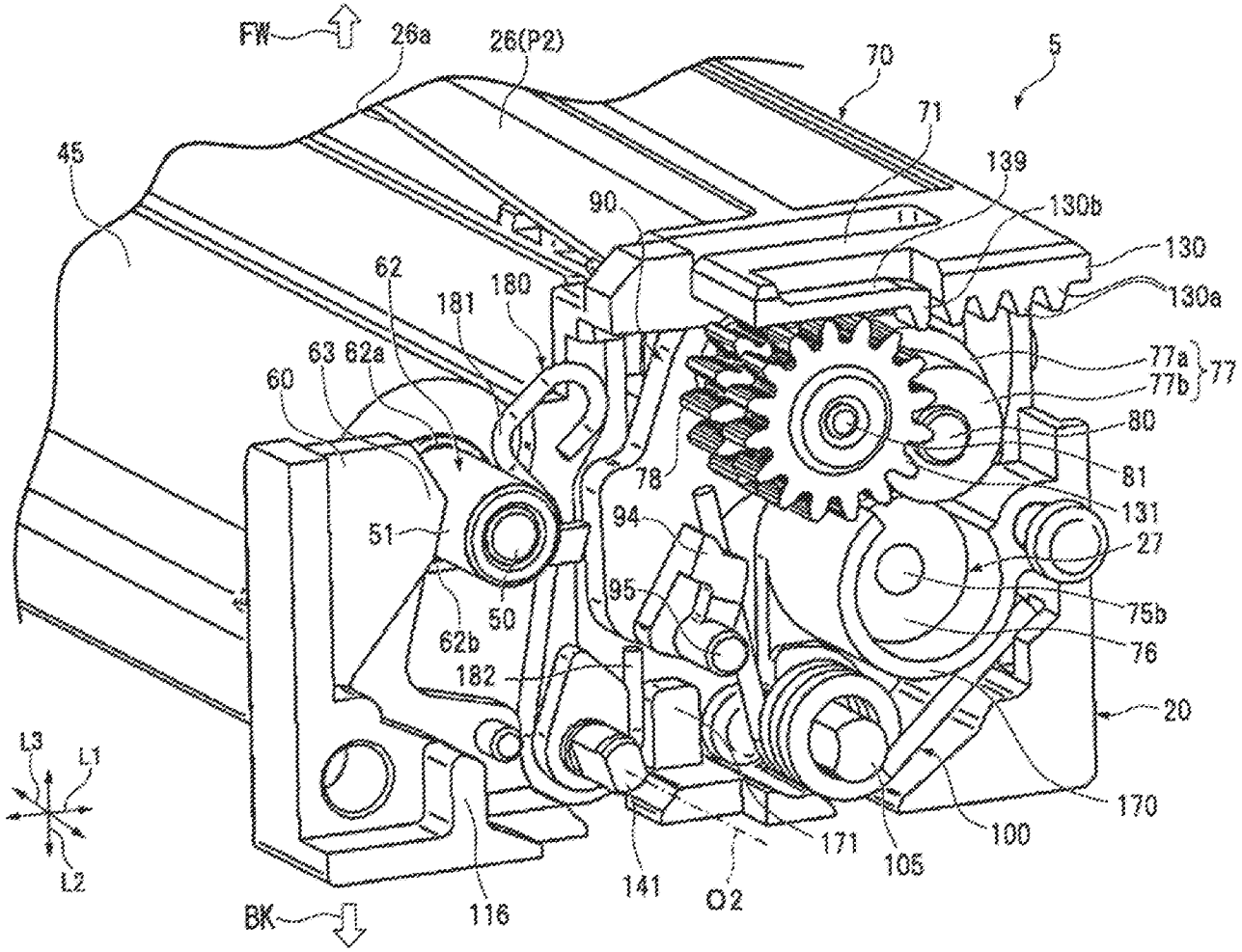
FIG. 24 is a perspective view for illustrating a state in which the lock arm is removed from the state illustrated in FIG. 23.

FIG. 21 to FIG. 24 are illustrations of one side surface of a thermal printer according to another embodiment of the present invention. Specifically, FIG. 21 is a side view for illustrating the thermal printer according to the another embodiment of the present invention when seen from a direction indicated by the arrow "A" of FIG. 5. FIG. 22 is a side view for illustrating a state in which a lock arm is removed from the state illustrated in FIG. 21. FIG. 23 is a perspective view for illustrating mechanisms of FIG. 21. FIG. 24 is a perspective view for illustrating a state in which the lock arm is removed from the state illustrated in FIG. 23.

Figure 25:
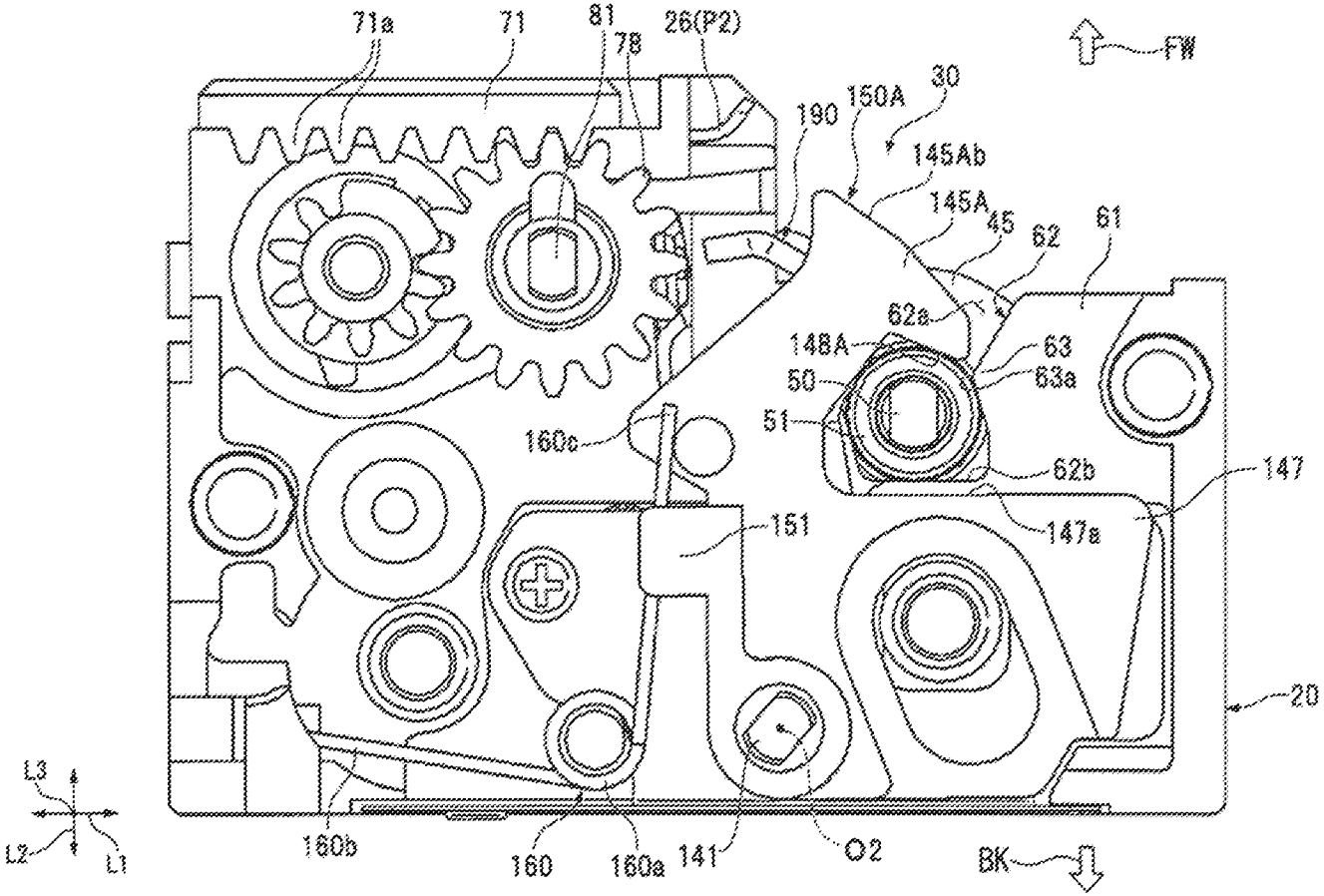
FIG. 25 is a side view for illustrating a periphery of another lock arm in the thermal printer according to the another embodiment of the present invention.
Figure 26:
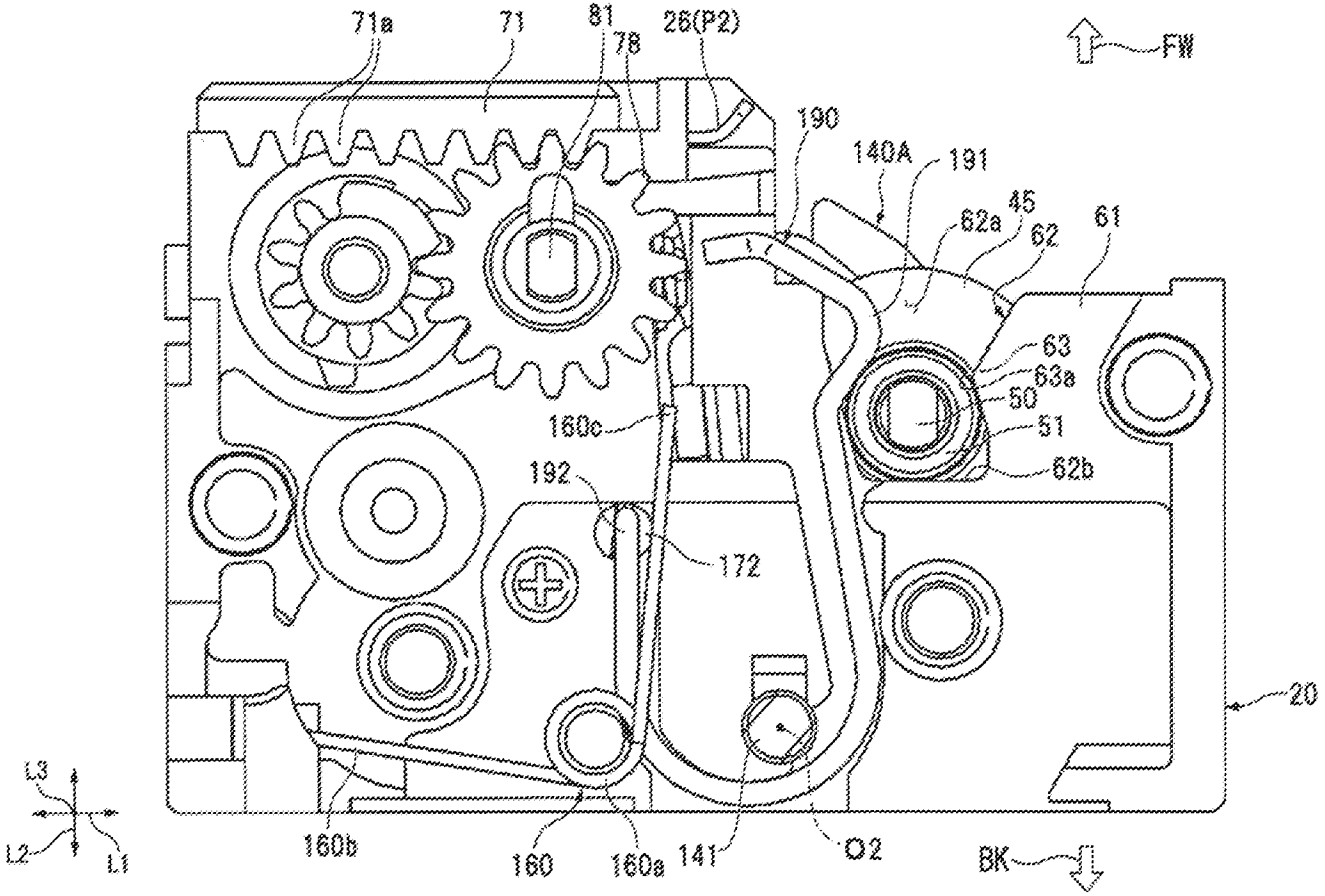
FIG. 26 is a side view for illustrating a state in which the another lock arm is removed from the state illustrated in FIG. 25.
Figure 27:
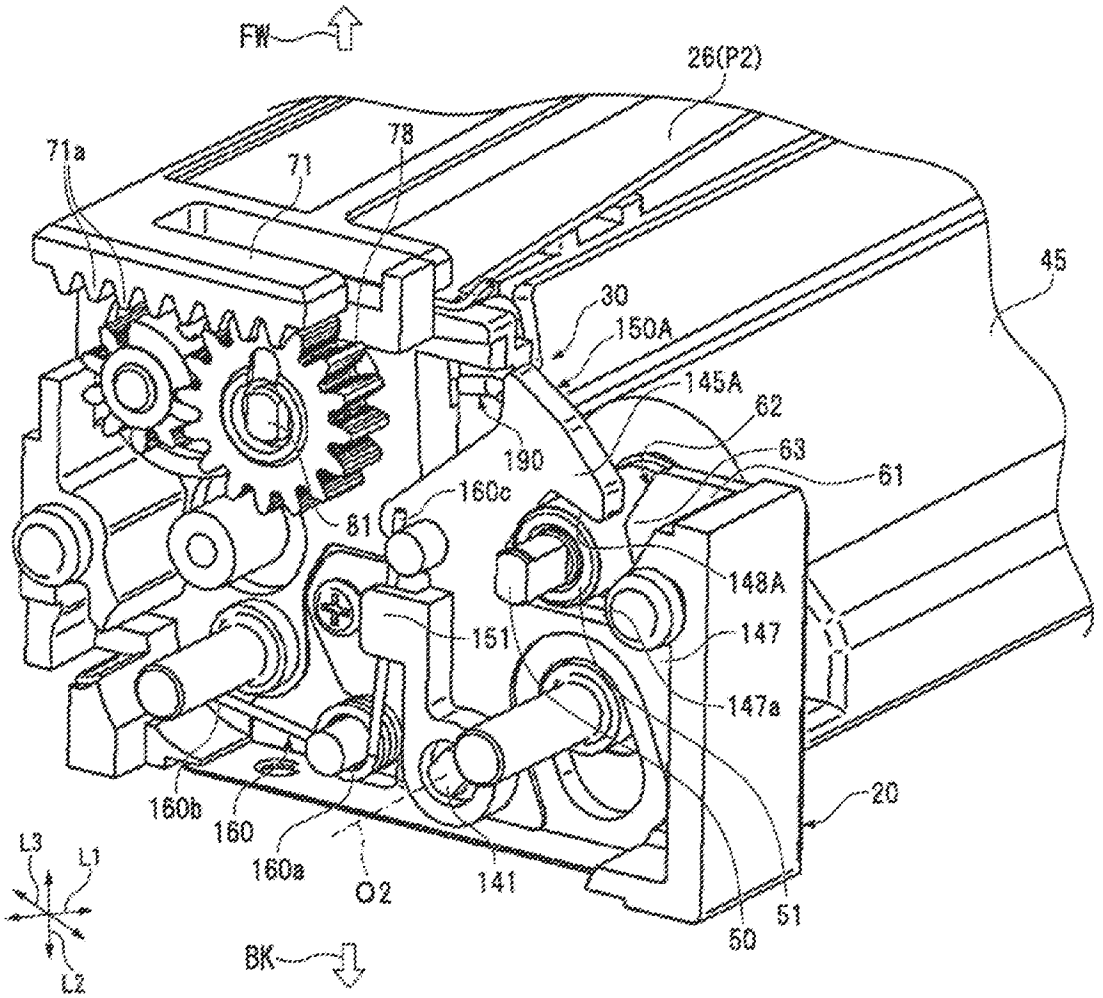
FIG. 27 is a perspective view for illustrating mechanisms of FIG. 25.
Figure 28:
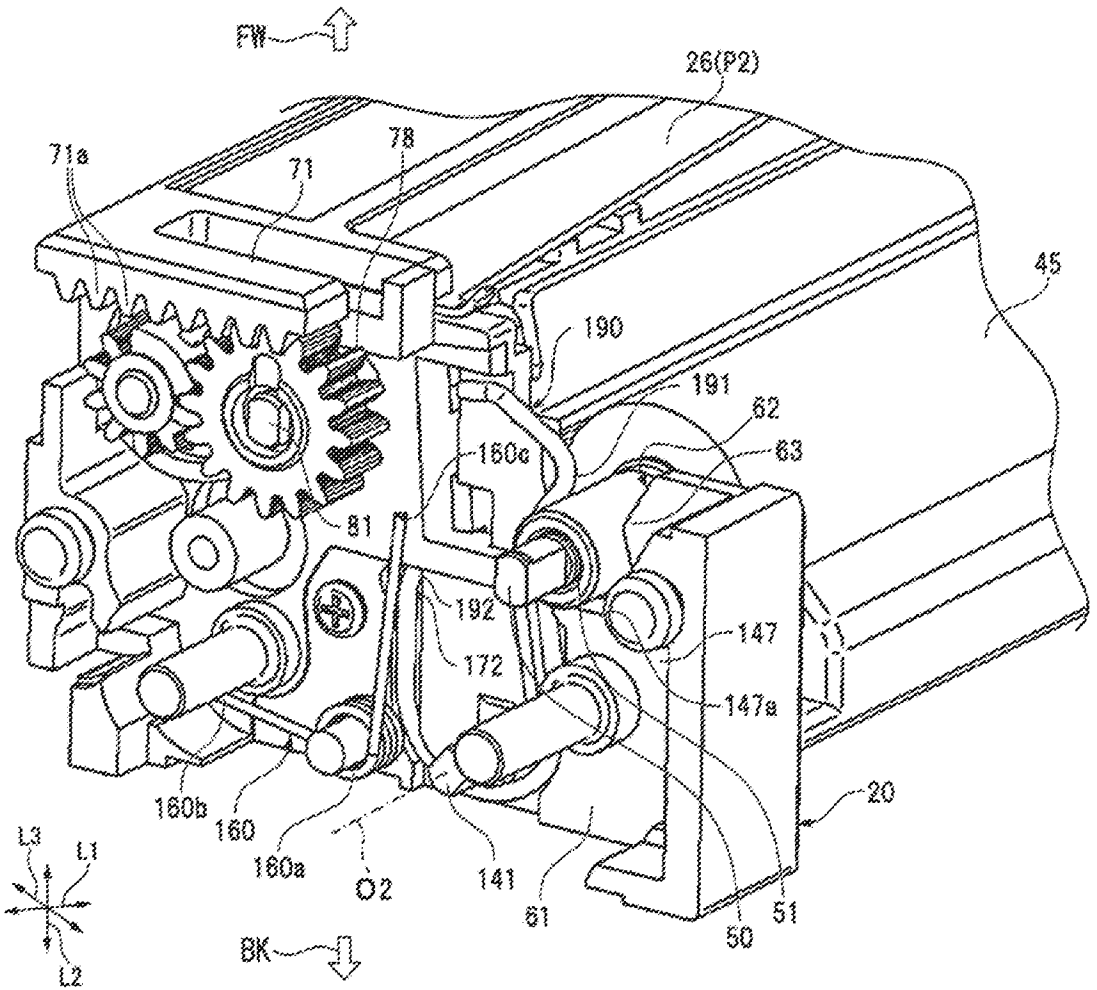
FIG. 28 is a perspective view for illustrating a state in which the another lock arm is removed from the state illustrated in FIG. 27.
Figure 29:
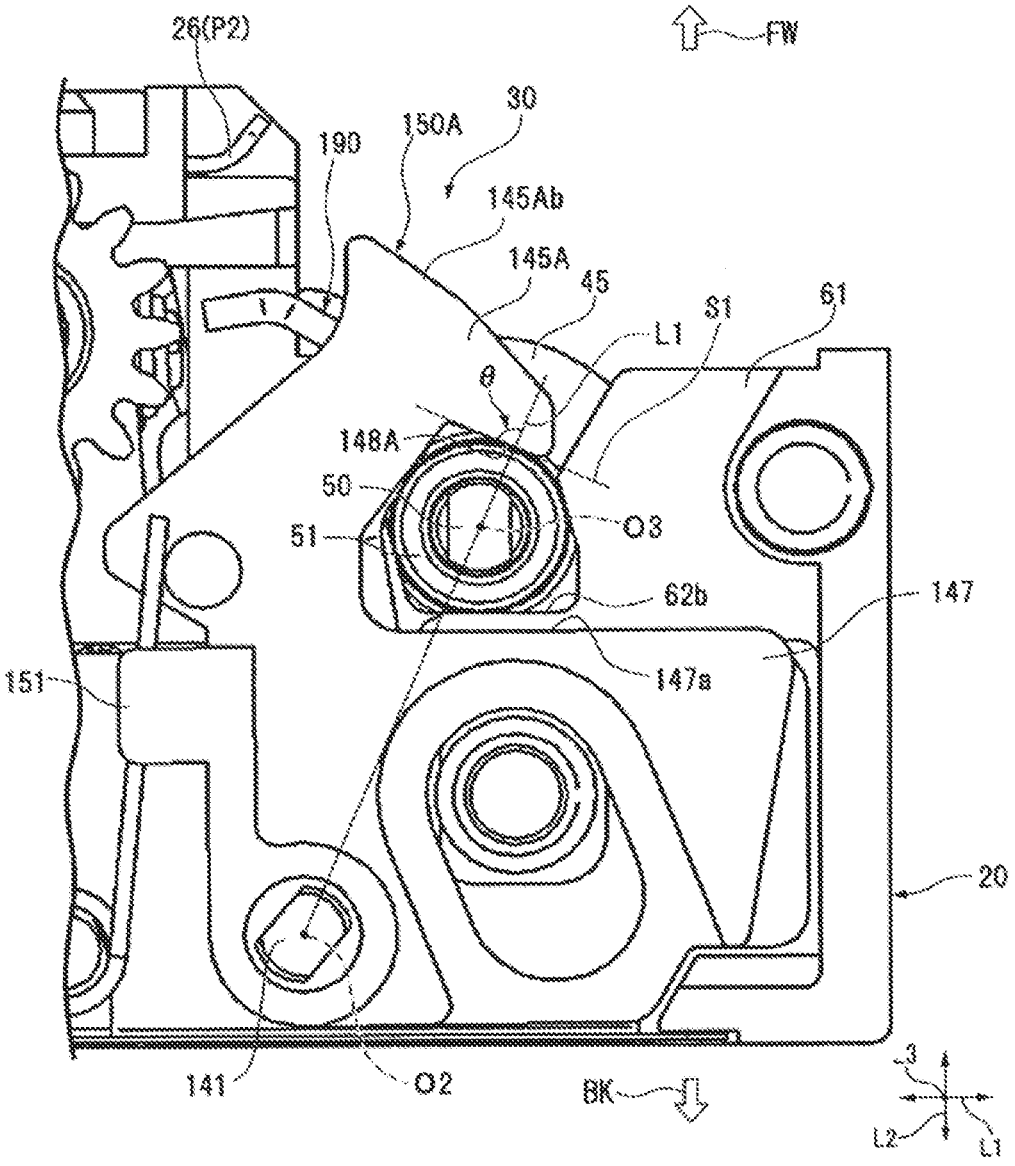
FIG. 29 is an enlarged view for illustrating a main part of the another lock arm of FIG. 25.

Further, FIG. 25 to FIG. 29 are illustrations of another side surface of the thermal printer according to the another embodiment of the present invention. Specifically, FIG. 25 is a side view for illustrating a periphery of another lock arm in the thermal printer according to the another embodiment of the present invention. FIG. 26 is a side view for illustrating a state in which the another lock arm is removed from the state illustrated in FIG. 25. FIG. 27 is a perspective view for illustrating mechanisms of FIG. 25. FIG. 28 is a perspective view for illustrating a state in which the another lock arm is removed from the state illustrated in FIG. 27. FIG. 29 is an enlarged view for illustrating a main part of the another lock arm of FIG. 25.

As illustrated in FIG. 21 to FIG. 24, a surrounding wall 170 is formed upright on the one side wall portion 60 of the head frame 20 so as to surround a circumference of the drive intermediate wheel 76 except for a meshing portion thereof. Meanwhile, although not shown, on the inner surface of the gear cover 22 to be mounted to the side wall portion 60, a shaft portion is formed at a position corresponding to the surrounding wall 170 so as to have a shape conforming to the shape of the surrounding wall 170. With this configuration, positioning accuracy when the gear cover 22 is mounted to the side wall portion 60 can be increased.

Further, a lock claw portion 145A of each of a pair of lock arms 140A and 150A in this embodiment has a shape different from that of the lock claw portion 145 of each of the lock arms 140 and 150 in the above-mentioned embodiment. As illustrated in FIG. 29, the lock claw portion 145A includes a disengagement preventing surface 148A, which is straight and configured to prevent disengagement of the platen bearing 51 from the receiving groove 62 through the opening 62*a* when the lock claw portion 145A is in the lock state. Further, a line L1 extending from the swing axis O2 of the lock arm 150A and passing through a center of the platen bearing 51, and the disengagement preventing surface 148A (S1) cross at right angles. The shape of the lock claw portion 145A of the lock arm 140A also has the same features.

As described above, in the platen lock mechanism 30 in this embodiment, the line extending from the swing axis of each of the lock arms 140A and 150A and passing through a center O3 of each of the platen bearings 51, and a bearing holding surface S1 formed on the lock claw portion 145A of each of the lock arms 140A and 150A cross at right angles. With this structure, even when the platen roller 45 in the lock state is pulled by the external force in a direction of being disengaged from the receiving grooves 62, a force of moving the lock arms 140A and 150A in an unlocking direction (that is, direction of being moved away from the platen bearings 51) is not generated, thereby being capable of preventing disengagement of the platen roller 45.

Further, the right and left side wall portions 60 and 61 in this embodiment include platen support springs 180 and 190, respectively. The platen support springs 180 and 190 are each formed of, for example, a wire spring. The platen support springs 180 and 190 are urging members configured to assist holding of the platen bearings 51 in the receiving grooves 62.

As illustrated in FIG. 21 to FIG. 24, the platen support spring 180 is arranged between the one side wall portion 60 and the lock arm 140A. A bearing pressing portion 181 having a mountain shape is formed on one end side of the platen support spring 180, and is configured to press the platen bearing 51 in the receiving groove 62 in a direction of preventing disengagement of the platen bearing 51. Another end side of the platen support spring 180 is bent along a circumference of the coupling shaft portion 141, and another end portion 182 of the platen support spring 180 is locked to the side wall portion 60 through a locking portion 171 formed on the side wall portion 60.

As illustrated in FIG. 25 to FIG. 29, the platen support spring 190 is arranged between the another side wall portion 61 and the lock arm 150A. A bearing pressing portion 191 having a mountain shape is formed on one end side of the platen support spring 190, and is configured to press the platen bearing 51 in the receiving groove 62 in a direction of preventing disengagement of the platen bearing 51. Another end side of the platen support spring 190 is bent along the circumference of the coupling shaft portion 141, and another end portion 192 of the platen support spring 190 is locked to the side wall portion 61 through a locking hole 172 formed in the side wall portion 61.

According to the platen support springs 180 and 190 configured as described above, the bearing pressing portions 181 and 191 always urge the platen bearings 51 in the receiving grooves 62 toward the groove bottom portions 62*b*, and assist holding of the platen roller 45. Thus, even when there are gaps between the disengagement preventing surfaces 148A of the lock arms 140A and 150A and the platen bearings 51 when the lock arms 140A and 150A are in the lock state, the platen bearings 51 can be held while play caused by the gaps is absorbed. As a result, room can be given to design tolerance of the lock arms 140A and 150A described above, thereby being capable of achieving smooth swing of the lock arms 140A and 150A, and reliable prevention of disengagement of the platen bearings 51 by the disengagement preventing surfaces 148A described above. Further, the bearing pressing portion 181 of the platen support spring 180 and the bearing pressing portion 191 of the platen support spring 190 each have a mountain shape, and hence do not hinder actions of disengaging the platen roller 45 more than necessary at the time of disengaging the platen roller 45.

Next, a modification example of the another embodiment of the present invention is described with reference to the drawings. In the modification example, the same components as those of the above-mentioned embodiments are denoted by the same reference symbols, and description thereof is omitted. Points different from those of the above-mentioned embodiments are mainly described as follows. Specifically, along with movement of the operation lever 28 from the lock position P3 toward the unlock position P5 side, the platen support spring 180 on the operation lever 28 side is swung in a direction of releasing holding of the platen bearing 51, thereby allowing disengagement of the platen bearing 51 from the receiving groove 62 through the opening 62*a*.

Figure 30:
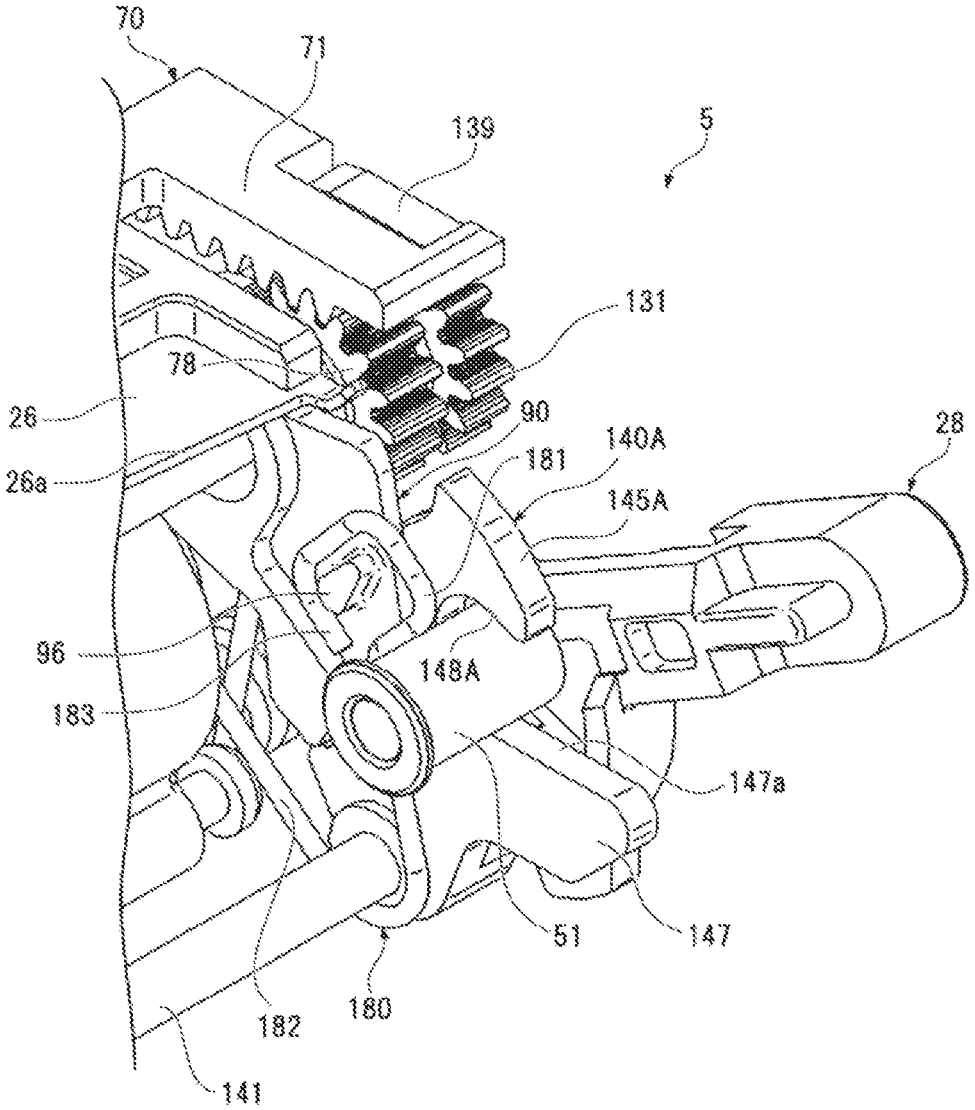
FIG. 30 is a perspective view for illustrating a main part of a thermal printer according to a modification example of the another embodiment of the present invention when a peripheral portion of the operation lever is seen from an inner surface side of the operation lever.

FIG. 30 is a perspective view for illustrating a main part of a thermal printer according to the modification example of the another embodiment of the present invention when a peripheral portion of the operation lever is seen from an inner surface side of the operation lever. In FIG. 30, illustrations of a part of components are omitted in order to more clearly illustrate a configuration that is different from those of the above-mentioned embodiments. However, in actuality, the omitted components are present in the same manner as those of the above-mentioned embodiments.

As illustrated in FIG. 30, a protruding portion 96 having a boss shape is formed on an inner surface of the swing plate 90. When the swing plate 90 is swung, one end portion 183 of the platen support spring 180 is brought into abutment against the protruding portion 96. Therefore, when the swing plate 90 is swung through operation of pushing the operation lever 28, in synchronization with swing of the swing plate 90, the one end portion 183 of the platen support spring 180 and the bearing pressing portion 181 are pushed up to a side opposite to the platen bearing 51. A series of actions of this is described with reference to FIG. 31 to FIG. 33. Also in FIGS. 31A, 31B to FIGS. 33A, 33B, illustrations of a part of components are omitted in order to more clearly illustrate the configuration different from those of the above-mentioned embodiments. However, in actuality, the omitted components are present in the same manner as those of the above-mentioned embodiments.

Figure 31A:
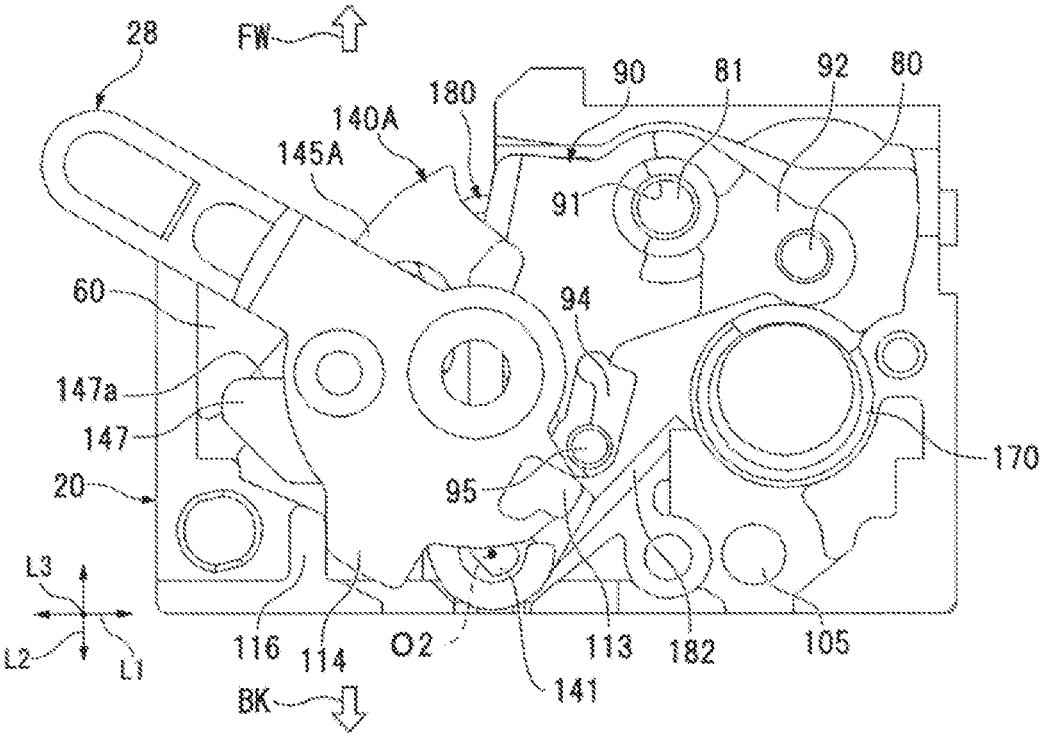
FIG. 31A is a side view for illustrating a main part of the thermal printer in a first stage (lock state) in the modification example of the another embodiment of the present invention when seen from an outer surface side of the operation lever.
Figure 31B:
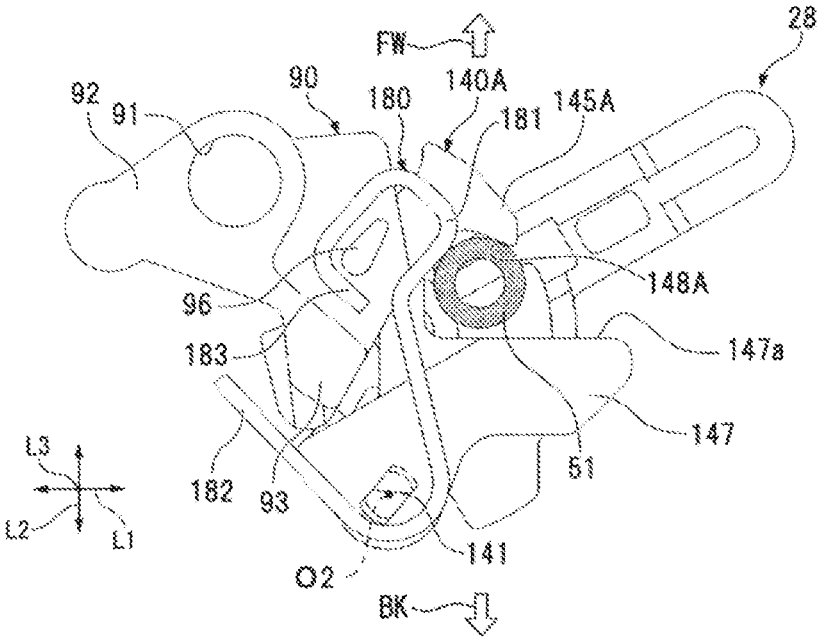
FIG. 31B is a side view for illustrating a main part of the thermal printer in the first stage (lock state) illustrated in FIG. 31A when seen from the inner surface side of the operation lever.
Figure 32A:
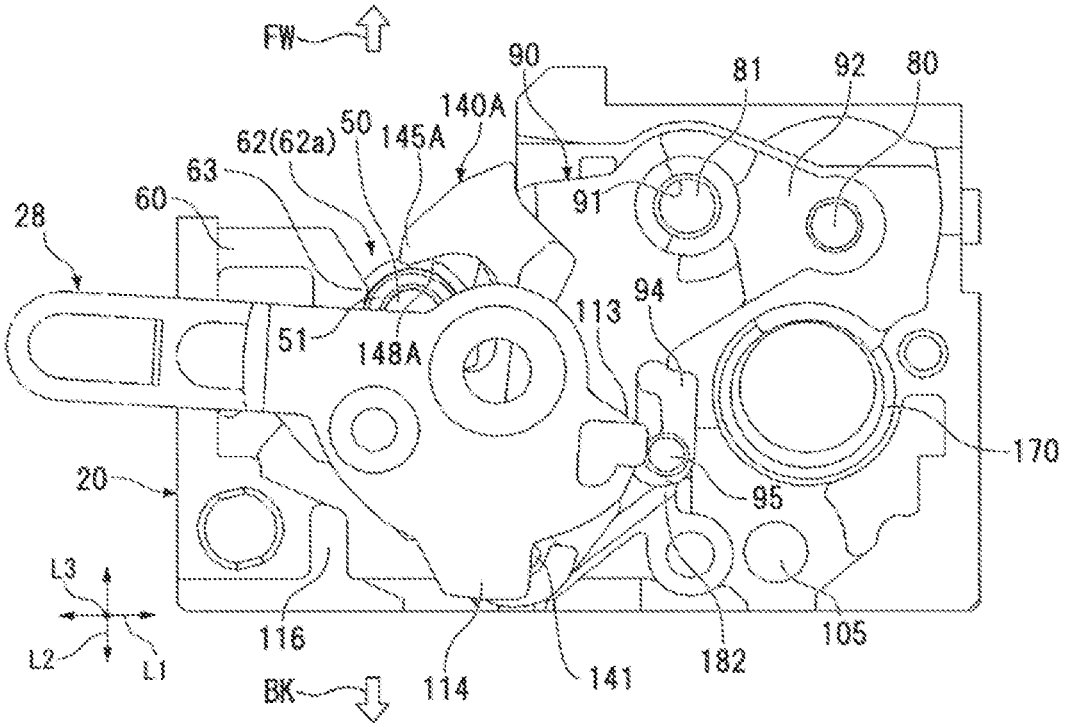
FIG. 32A is a side view for illustrating a main part of the thermal printer in a second stage (intermediate state) shifted from the state illustrated in FIG. 31A through operation of pushing the operation lever.
Figure 32B:
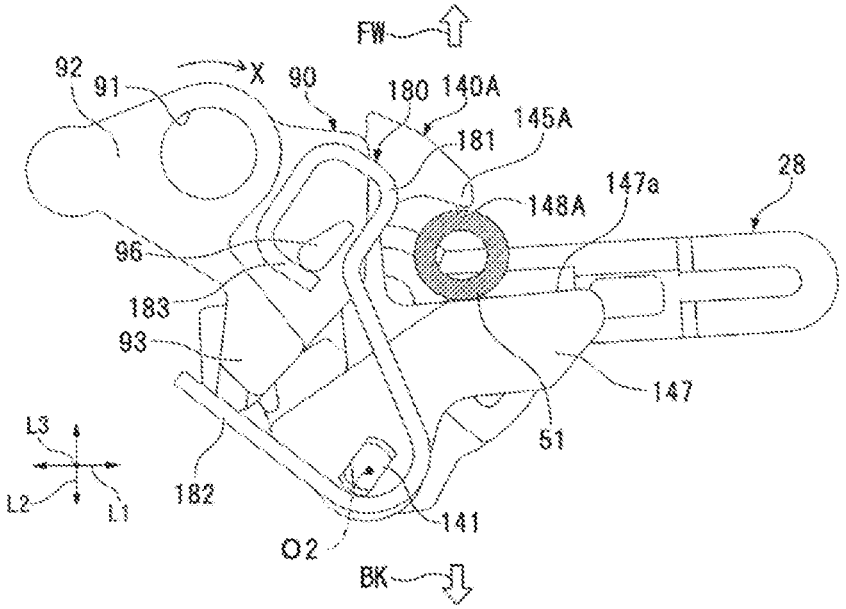
FIG. 32B is a side view for illustrating a main part of the thermal printer in the second stage (intermediate state) illustrated in FIG. 32A when seen from the inner surface side of the operation lever.
Figure 33A:
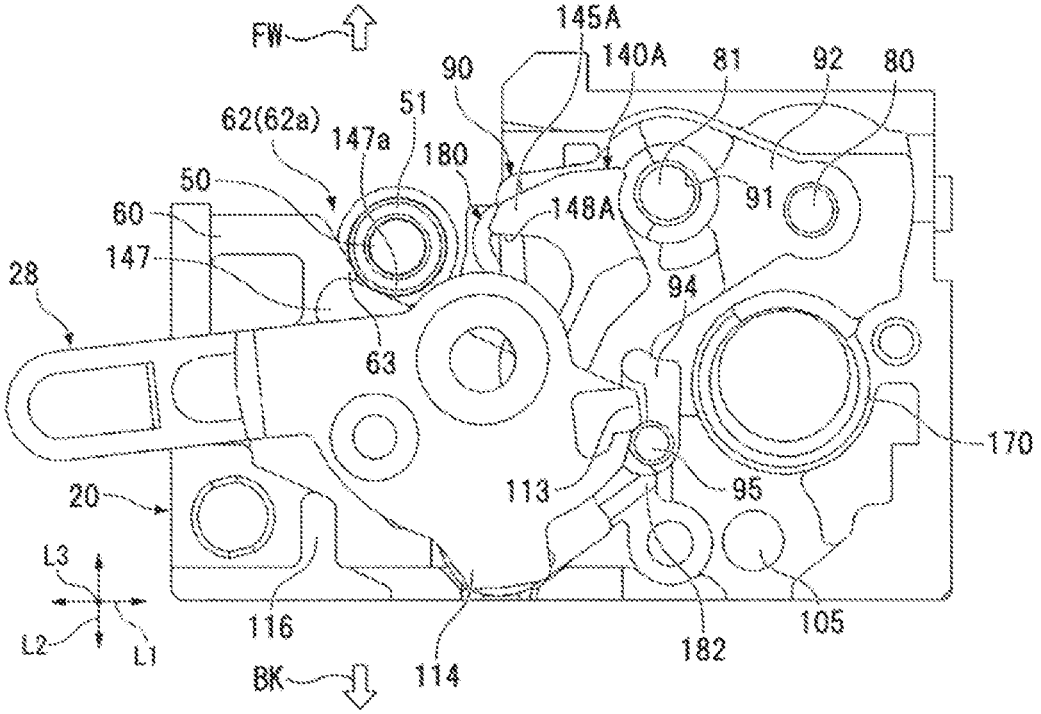
FIG. 33A is a side view for illustrating a main part of the thermal printer in a third stage (unlock state) shifted from the state illustrated in FIG. 32A through operation of pushing the operation lever.
Figure 33B:
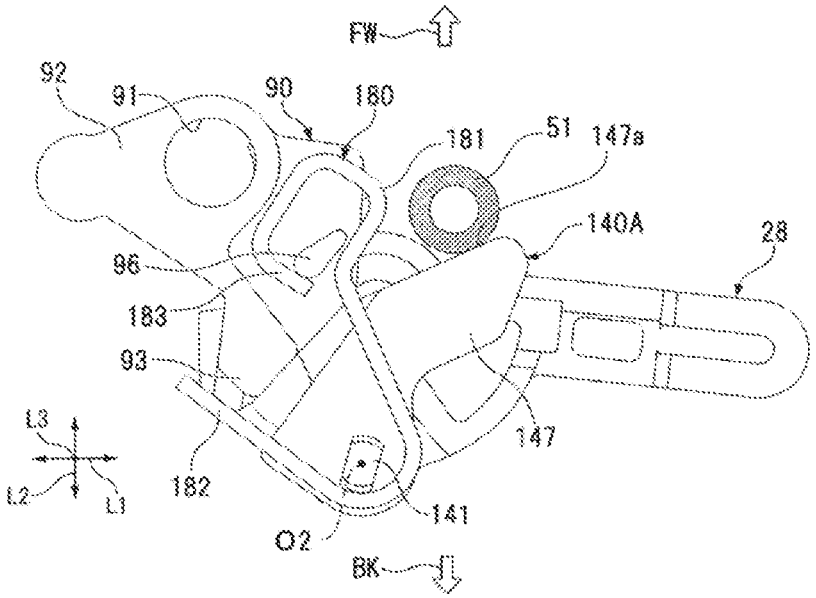
FIG. 33B is a side view for illustrating a main part of the thermal printer in the third stage (unlock state) illustrated in FIG. 33A when seen from the inner surface side of the operation lever.

FIG. 31A is a side view for illustrating a main part of the thermal printer in a first stage (lock state) in the modification example of the another embodiment of the present invention when seen from an outer surface side of the operation lever 28. FIG. 31B is a side view for illustrating a main part of the thermal printer in the first stage (lock state) illustrated in FIG. 31A when seen from the inner surface side of the operation lever 28. FIG. 32A is a side view for illustrating a main part of the thermal printer in a second stage (intermediate state) shifted from the state illustrated in FIG. 31A through the operation of pushing the operation lever. FIG. 32B is a side view for illustrating a main part of the thermal printer in the second stage (intermediate state) illustrated in FIG. 32A when seen from the inner surface side of the operation lever. FIG. 33A is a side view for illustrating a main part of the thermal printer in a third stage (unlock state) shifted from the state illustrated in FIG. 32A through the operation of pushing the operation lever. FIG. 33B is a side view for illustrating a main part of the thermal printer in the third stage (unlock state) illustrated in FIG. 33A when seen from the inner surface side of the operation lever.

As illustrated in FIG. 31A, in the first stage (lock state), the engagement pin 95 formed on the second plate portion 93 of the swing plate 90 is not held in abutment against the pushing-up cam 113 formed on the lever plate 110 of the operation lever 28. Further, as illustrated in FIG. 31B, the protruding portion 96 of the swing plate 90 is not held in abutment against the one end portion 183 of the platen support spring 180. Therefore, in the first stage (lock state), the bearing pressing portion 181 of the platen support spring 180 urges the platen bearing 51 in the receiving groove 62 toward the groove bottom portion 62*b*, thereby assisting holding of the platen roller 45.

As illustrated in FIG. 32A, in the second stage (intermediate state), through the operation of pushing the operation lever 28, the engagement pin 95 of the swing plate 90 and the pushing-up cam 113 of the operation lever 28 are brought into abutment against each other. When the operation lever 28 is operated to be further pushed, the swing plate 90 is swung in a direction indicated by the arrow "X" of FIG. 32B about the pinion support shaft 81 inserted through the insertion hole 91. As illustrated in FIG. 32B, along with swing of the swing plate 90, the protruding portion 96 and the one end portion 183 of the platen support spring 180 are brought into abutment against each other, and the one end portion 183 side of the platen support spring 180 is pushed up in a direction of being moved away from the platen bearing 51. Thus, the bearing pressing portion 181 of the platen support spring 180 is retreated in a direction of being moved away from the platen bearing 51 in the receiving groove 62, thereby opening a disengagement path for the platen bearing 51.

As illustrated in FIG. 33A, in the third stage (unlock state), when the operation lever 28 is operated to be further pushed from the state illustrated in FIG. 32A and FIG. 32B, the lock arm 140A is swung in a direction of being retreated from the receiving groove 62, and the pushing-up arm 147 forcibly pushes the platen bearing 51 toward the opening 62*a* side. At this time, the platen support spring 180, which assists holding of the platen roller 45 when the thermal printer is in the lock state, is already in the second stage (intermediate state) and retreated from the receiving groove 62, and hence the platen bearing 51 in the receiving groove 62 can be smoothly disengaged through the opening 62*a*.

As described above, according to the modification example, the platen support spring 180 configured to assist holding of the platen roller 45 is provided. With this configuration, even when there is a gap between the disengagement preventing surface 148A of the lock arm 140A and the platen bearing 51 when the thermal printer is in the lock state, the platen bearing 51 can be held while play caused by the gap is absorbed. Further, at the time of unlocking, before the pushing-up arm 147 pushes the platen bearing 51, the platen support spring 180 is swung in a direction of being retreated from the receiving groove 62 so as to release holding of the platen bearing 51, thereby being capable of achieving smooth disengagement of the platen roller 45. As a result, a force of pushing down the operation lever 28, which is required for releasing the platen roller 45, can be reduced, and hence operability can be improved.

The embodiments of the present invention have been described above. However, those embodiments are presented as examples and are not intended to limit the scope of the invention. Those embodiments may be implemented in other various modes, and various kinds of omissions, replacements, and modifications can be made without departing from the gist of the invention. The embodiments and modification examples thereof include, for example, those which can be easily assumed by a person skilled in the art, those which are substantially the same, and those which fall within a scope of equivalence.

For example, in the above-mentioned embodiments, description is made of the example in which the fixed blade 46 is provided on the printer cover 3 (specifically, platen unit 6) and the movable blade 26 is provided on the casing 2 (specifically, head unit 5), but the present invention is not limited to this case. For example, the fixed blade 46 may be provided on the casing 2 side, and the movable blade 26 may be provided on the printer cover 3 side. However, when the fixed blade 46 is provided on the printer cover 3 as in the above-mentioned embodiments, it is not required that the drive mechanism 27 configured to drive the movable blade 26 be provided on the printer cover 3. Accordingly, a weight of the printer cover 3 can be reduced, and operability at the time of opening and closing the printer cover 3 can be secured satisfactorily.

Further, in the above-mentioned embodiments, description is made of the example in which the fixed blade 46 is retained stationarily, and paper jam is removed by returning the movable blade 26 to the standby position P2 through the operation of the operation lever 28, but the present invention is not limited to this case. For example, there may also be adopted a configuration in which the fixed blade 46 is moved away from the movable blade 26 when the movable blade 26 is returned to the standby position P2 through the operation of the operation lever 28. In this case, for example, an action of moving the fixed blade 46 away from the movable blade 26 can also be performed through the operation of the operation lever 28.

Still further, in the above-mentioned embodiments, description is made of the example in which the operation lever 28 is operated in synchronization with a pivoting action of the operation lever 19 provided on the casing 2, but the present invention is not limited to this case. For example, there may also be adopted a configuration in which the distal end portion of the operation lever 28 is exposed to the outside of the casing 2 so that the operation lever 28 can be operated directly from the outside of the casing 2.

Still further, in the above-mentioned embodiments, description is made of the example in which the speed-increasing mechanism 136 includes the sun gear 133, the planetary gear 134, and the internal gear 135. However, for example, the speed-increasing mechanism 136 may have another configuration. Moreover, in the above-mentioned embodiments, a case of providing the return mechanism 29 is described as an example. However, the return mechanism 29 is dispensable, and may be omitted. In addition, even in the case of providing the return mechanism 29, another configuration may be adopted.

Moreover, in the above-mentioned embodiments, both of the pair of platen bearings 51 are pressed through use of the pair of lock arms 140 and 150, but the present invention is not limited to this case. There may also be adopted a configuration in which at least one of the platen bearings 51 is pressed through use of one lock arm.

What is claimed is:

1. A printing unit, comprising:

a head unit including a thermal head configured to perform printing on a recording sheet;

a platen unit which is detachably combined with the head unit, and includes:

a platen roller configured to feed the recording sheet; and a pair of platen bearings configured to support both end portions of the platen roller in a rotatable manner;

an operation lever which is movable about a rotation axis between a lock position of locking the platen unit to the head unit and an unlock position of unlocking the platen unit from the head unit;

a platen lock mechanism which includes a lock arm swingable about a swing axis parallel to the platen roller, and is configured to switch the lock arm between a lock state of locking the platen roller and an unlock state of unlocking the platen roller; and an urging member configured to urge the lock arm about the swing axis so as to maintain the lock state, wherein the head unit has a pair of receiving grooves which is configured to allow the pair of platen bearings to be fitted therein through openings of the pair of receiving grooves, and configured to receive the pair of platen bearings in contact with groove bottom portions of the pair of receiving grooves when the operation lever is at the lock position, wherein the lock arm comprises a lock claw portion, wherein the lock arm is configured to cause the lock claw portion to press at least one of the pair of platen bearings received in the receiving groove from the opening side when the operation lever is at the lock position, and is configured to allow disengagement of the at least one of the pair of platen bearings from the receiving groove through the opening by being swung about the swing axis along with movement of the operation lever from the lock position toward the unlock position side, wherein the lock arm includes a pushing-up arm configured to push the at least one of the pair of platen bearings from the groove bottom portion toward the opening side along with movement of the operation lever from the lock position toward the unlock position, and wherein the urging member urges the lock claw portion of the lock arm toward the platen unit side and away from the head unit.

2. The printing unit according to claim 1, wherein the lock arm allows disengagement of the at least one of the pair of platen bearings from the receiving groove through the opening by the lock claw portion of the lock arm being swung about the swing axis from the platen unit side toward the head unit side along with movement of the operation lever from the lock position toward the unlock position side.

3. The printing unit according to claim 1, wherein the pushing-up arm is held in non-contact with the at least one of the pair of platen bearings when the operation lever is at the lock position.

4. The printing unit according to claim 1, wherein on an inner surface of the receiving groove, an inclined guide protrusion configured to guide the at least one of the pair of platen bearings toward the groove bottom portion is formed so as to decrease an opening width from the opening side toward the groove bottom portion side, and wherein the pushing-up arm pushes the at least one of the pair of platen bearings so as to move a roller center of the platen roller more toward the opening side than an apex portion of the guide protrusion.

5. The printing unit according to claim 1, wherein the lock arm includes a pair of lock arms arranged on both sides of the platen roller across the platen roller so as to correspond to the pair of platen bearings, respectively, and wherein the platen lock mechanism includes a coupling shaft portion that extends along the swing axis and is configured to couple the pair of lock arms to each other.

6. The printing unit according to claim 1, further comprising:

a fixed blade provided on one of the head unit and the platen unit;

a movable blade provided on another one of the head unit and the platen unit so as to be movable relative to the fixed blade; and a drive mechanism which includes a drive rack coupled to the movable blade, and is configured to move the movable blade between a standby position at which the movable blade is away from the fixed blade and a cutting position at which the movable blade climbs over the fixed blade.

7. The printing unit according to claim 6, further comprising a return mechanism configured to move the movable blade from the cutting position to the standby position through use of an operating force generated along with operation of the operation lever from the lock position toward the unlock position under a state in which the movable blade is stopped at the cutting position before the platen lock mechanism switches the lock arm to the unlock state of unlocking the platen roller.

8. The printing unit according to claim 7, wherein the return mechanism includes:

a return rack formed on the drive rack;

a return pinion, which meshes with rack teeth of the return rack;

a return gear and a sun gear supported so as to be rotatable about the rotation axis of the operation lever under a state of being arranged coaxially with the rotation axis;

a planetary gear which meshes with the sun gear, and revolves along with movement of the operation lever; and an internal gear with which the planetary gear meshes, and wherein the return gear is allowed to mesh with the return pinion.

9. The printing unit according to claim 8, wherein the rack teeth are formed on a side opposite to a blade edge of the movable blade so as to mesh with the return pinion when the movable blade is at the cutting position, and to be disengaged from the return pinion when the movable blade is at the standby position.

10. The printing unit according to claim 1, wherein the lock claw portion of the lock arm includes a disengagement preventing surface, which is straight and configured to prevent disengagement of the at least one of the pair of platen bearings from the receiving groove through the opening when the lock arm is in the lock state, and wherein a line extending from the swing axis of the lock arm and passing through a center of the at least one of the pair of platen bearings, and the disengagement preventing surface cross at right angles.

11. The printing unit according to claim 1, further comprising a platen support spring configured to assist holding of the at least one of the pair of platen bearings in the receiving groove, wherein the platen support spring allows disengagement of the at least one of the pair of platen bearings from the receiving groove through the opening by being moved in a direction of releasing holding of the at least one of the pair of platen bearings along with movement of the operation lever from the lock position toward the unlock position side before the pushing-up arm pushes the at least one of the pair of platen bearings.

12. A thermal printer, comprising:

the printing unit of claim 1;

a printer main body which includes a recording sheet receiving portion configured to receive the recording sheet, and includes one of the head unit and the platen unit mounted thereto; and a printer cover which is coupled to the printer main body so as to be pivotable, and includes another one of the head unit and the platen unit mounted thereto.

* * * * *